US008146990B2

(12) United States Patent
Bock

(10) Patent No.: US 8,146,990 B2
(45) Date of Patent: Apr. 3, 2012

(54) MECHANISM FOR AN OFFICE CHAIR

(75) Inventor: Hermann Bock, Pyrbaum (DE)

(73) Assignee: Bock 1 GmbH & Co. KG, Postbauer-Heng (DE)

( * ) Notice: Subject to any disclaimer, the term of this patent is extended or adjusted under 35 U.S.C. 154(b) by 298 days.

(21) Appl. No.: 12/422,457

(22) Filed: Apr. 13, 2009

(65) Prior Publication Data

US 2009/0267394 A1 Oct. 29, 2009

(30) Foreign Application Priority Data

Oct. 13, 2006 (DE) ..... 10 2006 049 040
May 8, 2007 (DE) ..... 10 2007 022 015

(51) Int. Cl.
*A47C 1/032* (2006.01)

(52) U.S. Cl. ..... 297/300.4; 297/300.5; 297/303.3; 297/303.4; 297/303.5

(58) Field of Classification Search ..... 297/300.4, 297/300.5, 301.3, 301.4, 302.3, 302.4, 303.3, 297/303.4, 303.5
See application file for complete search history.

(56) References Cited

U.S. PATENT DOCUMENTS 3,455,601 A 7/1969 Lie
3,602,475 A * 8/1971 Sedlock ..... 248/591
4,151,973 A * 5/1979 Sedlock ..... 248/576
4,743,065 A * 5/1988 Meiller et al. ..... 297/300.3
4,744,603 A * 5/1988 Knoblock ..... 297/300.4
4,758,045 A * 7/1988 Edel et al. ..... 297/300.2
4,776,633 A * 10/1988 Knoblock et al. ..... 297/300.4
5,080,318 A 1/1992 Takamatsu et al.
5,224,758 A 7/1993 Takamatsu et al.
5,348,372 A * 9/1994 Takamatsu et al. ..... 297/303.1
5,370,445 A * 12/1994 Golynsky ..... 297/326
5,388,889 A * 2/1995 Golynsky ..... 297/302.3
5,487,591 A * 1/1996 Knoblock ..... 297/452.14
5,547,252 A 8/1996 Pfenniger
(Continued)

FOREIGN PATENT DOCUMENTS

DE 3537203 A1 * 4/1986
(Continued)

OTHER PUBLICATIONS

International Search Report, dated Mar. 10, 2008.

*Primary Examiner* — David Dunn
*Assistant Examiner* — David E Allred
(74) *Attorney, Agent, or Firm* — Laurence A. Greenberg; Werner H. Stemer; Ralph E. Locher

(57) ABSTRACT

A mechanism for an office chair having a backrest support which may be pivoted rearwardly. Adjustment of the backrest pivotal motion is accomplished by the mechanism having a base support which may be positioned on a chair column, a seat support, the backrest support which may be pivoted to the rear, and a pre-tensioned spring arrangement for enabling the mechanism to counter or oppose the movement of the backrest support. The seat support and the base support form a movable unit, which may be moved relative to the chair column depending on the weight of a user applying a load to the seat support. Movement of the movable unit causes an adjustment of the pre-tension of the spring arrangement and/or an adjustment of the spring constant of the spring arrangement.

11 Claims, 20 Drawing Sheets

U.S. PATENT DOCUMENTS

| | | | | |
|---|---|---|---|---|
| 5,584,533 | A * | 12/1996 | Schrewe | 297/300.2 |
| 5,611,598 | A * | 3/1997 | Knoblock | 297/452.14 |
| 5,909,924 | A * | 6/1999 | Roslund, Jr. | 297/300.4 |
| 6,015,187 | A * | 1/2000 | Roslund et al. | 297/300.4 |
| 6,523,896 | B1 * | 2/2003 | Uhlenbrock | 297/300.4 |
| 6,582,019 | B2 * | 6/2003 | Insalaco et al. | 297/300.4 |
| 6,709,056 | B2 * | 3/2004 | Bock | 297/300.4 |
| 6,709,058 | B1 * | 3/2004 | Diffrient | 297/320 |
| 6,840,578 | B1 * | 1/2005 | Su | 297/302.3 |
| 7,857,390 | B2 * | 12/2010 | Schmitz et al. | 297/300.1 |
| 7,992,937 | B2 * | 8/2011 | Plikat et al. | 297/300.2 |
| 2001/0000939 | A1 * | 5/2001 | Roslund et al. | 297/303.3 |
| 2002/0158495 | A1 * | 10/2002 | Kazuyoshi et al. | 297/300.4 |
| 2002/0171276 | A1 * | 11/2002 | Bock | 297/300.1 |
| 2002/0171277 | A1 * | 11/2002 | Bock | 297/300.2 |
| 2006/0163925 | A1 * | 7/2006 | Bock | 297/340 |
| 2008/0088163 | A1 | 4/2008 | Sander et al. | |
| 2011/0012409 | A1 * | 1/2011 | Bock | 297/285 |

FOREIGN PATENT DOCUMENTS

| | | | |
|---|---|---|---|
| DE | 43 09 439 | A1 | 9/1994 |
| DE | 43 41 071 | A1 | 6/1995 |
| DE | 690 21 353 | T2 | 1/1996 |
| DE | 690 28 500 | T2 | 1/1997 |
| DE | 42 35 691 | C2 | 3/1999 |
| DE | 19921153 | A1 * | 11/2000 |
| DE | 102 19 478 | B4 | 7/2006 |
| DE | 20 2005 004 880 | U1 | 8/2006 |
| EP | 0 638 265 | A2 | 2/1995 |
| WO | WO 2009103389 | A1 * | 8/2009 |

* cited by examiner

MECHANISM FOR AN OFFICE CHAIR

BACKGROUND OF THE INVENTION

Field of the Invention

The invention relates to a mechanism for an office chair, in particular an office chair comprising a backrest support which may be pivoted to the rear.

Various solutions are known from the prior art, by which the pivoting of the backrest of an office chair, in particular the "pivoting resistance", may be adjusted. To this end, complicated adjusting mechanisms are frequently used, which generally take up a considerable portion of the available constructional space, and which are relatively restrictive as regards the design of the office chair. Moreover, the adjustment of the pivoting of the backrest always has to be manually undertaken by the user of the office chair, for example by actuating an adjusting element or, however, by means of an external drive, for example an electric motor. It is a further drawback that the adjustment always takes place "instinctively", without a decision about any setting being necessarily based on ergonomic considerations.

An object of the present invention is to provide a solution which is particularly simple in terms of structure, for adjusting the pivoting of the backrest of an office chair.

This object is achieved by the mechanism set forth in the claims. Accordingly, the mechanism is provided with a base support which may be positioned on a chair column, a seat support, a backrest support which may be pivoted to the rear and a spring arrangement for acting on the mechanism counter to the movement of the backrest support. According to the invention, the mechanism is characterized in that the seat support and the base support form a moving unit which may be moved relative to the chair column depending on the weight of a user applying a load to the seat support, a movement of the moving unit resulting in an adjustment of the pretensioning of the spring arrangement and/or an adjustment of the spring constant of the spring arrangement.

A fundamental idea of the invention is to provide the adjustment of the pivoting of the backrest automatically, i.e. without the user of the office chair having to carry out additional steps therefor in any form, whether manually or by means of an external drive. Instead, according to the invention the adjustment of the pivoting of the backrest takes place fully automatically, solely by the user sitting on the office chair. The mechanism is automatically adjusted depending on the weight of the user—and thus adjustable from the ergonomic perspective for optimum pivoting features—by the spring arrangement defining the "pivoting resistance" of the backrest, being more or less pretensioned and/or the spring rate (also known as spring rigidity, spring hardness or spring constant) of the spring arrangement being altered.

BRIEF SUMMARY OF THE INVENTION

With a heavyweight user, this adjustment preferably takes place such that a high "pivoting resistance" opposes a pivoting of the backrest of the office chair whilst, in contrast thereto, a pivoting of the backrest with a lightweight user may be implemented considerably more easily. In this connection, it is left to the actual embodiment of the invention whether, when adjusting the pretensioning of the spring arrangement, one or more spring elements may be tensioned or alternatively relaxed. In other words, on the one hand, a spring element which is fully or partially relaxed in the unloaded state of the office chair may be tensioned when loaded, for example, or alternatively, a spring element which is pretensioned to a maximum extent or partially pretensioned in the resting state, is relaxed when a load is applied to the office chair. Preferably, however, even without a load being applied to the seat support by a user, an active impingement of the mechanism counter to the movement of the backrest support is carried out by a number of already pretensioned spring elements. It is left to the actual design of the invention whether the spring rate of one or more spring elements is altered and how the alteration of the spring rate is implemented.

In order to achieve an operation which is as simple and robust as possible with, at the same time, a simple structural design of the office chair, it is provided that the seat support and base support when applying a load to the seat support are moved by a user together as a moving unit relative to the fixed chair column, this relative movement being dependent on the weight of the user. The type of movement is initially unimportant for implementing the invention. Preferably, however, the movement is a linear movement in the vertical direction, i.e. in the direction in which the user also sits on the chair. In this manner, a direct and particularly easy transfer of the weight is possible for acting on the spring arrangement.

Advantageous embodiments of the invention are set forth in the sub-claims.

The pretensioning of the spring arrangement and the spring rate of the spring arrangement may be fundamentally adjusted according to the invention by two different methods. Firstly, it is possible to alter the position of at least one spring end of a spring element of the spring arrangement, with the overall position of the spring element remaining the same or being altered. This may, for example, take place by pulling apart or pressing together the spring ends of a helical spring or by twisting and/or deflecting one spring leg of a leg spring around the longitudinal axis of the spring extending through the spring center point against the other spring leg or relative to the other spring leg.

Secondly, it is possible to alter the position of the spring element itself relative to its fixed spring ends or, in a similar manner, at least the partially movable spring ends. This may be carried out by a leg spring, for example, by displacing the spring center point of the leg spring, when the bearing points are fixed. Both variants of the spring adjustment may be implemented according to the invention, depending on which requirements are set for the design of the seat mechanism.

A structurally simple solution and a compact design is achieved according to a particularly preferred embodiment of the invention, in particular when the seat support and the base support are arranged such that they carry out together the movement relative to the seat column, without therefore altering their relative position to one another. In other words, a direct and immediate common movement of the seat support and the base support is performed relative to the seat column. Force deflecting arrangements for moving the base support, such as for example levers between the seat support and the base support, are not provided. The seat support and the base support are moved instead on a single common path of motion. To this end, the base support and seat support may be connected to one another via corresponding connecting elements. As an alternative, however, it is also possible that the base support and the seat support are configured as a common component.

In addition, for a design which is as compact as possible a further embodiment is advantageous, according to which the base support and/or the seat support comprises a guide, in particular a linear guide for transmitting the relative movement to the spring arrangement. Preferably, the seat column in this case is guided directly or via a guide element in the base support and/or in the seat support, so that no additional components are required for implementing the invention. It is particularly advantageous if the linear guide is arranged vertically. By the design of the receiver as a linear guide, and the vertical arrangement thereof, a particularly simple and thus economical option is provided to convert the weight of the user of the office chair into a relative movement of the base support in the sense of a vertical deflection.

Moreover, the embodiment of the solution according to the invention may be implemented both by means of direct and by means of indirect influence on the spring arrangement, in particular by means of a direct and/or indirect impingement of a spring element of the spring arrangement. A direct impingement of a spring element is understood in this case as an alteration to the spring tension and/or the spring rate by a force acting directly on the spring element itself, whilst an indirect impingement is understood as the alteration of the spring tension and/or the spring rate by an indirect force acting on the spring element—i.e. for example via an auxiliary element.

A direct impingement of a spring element of the spring arrangement by the base support moving relative to the chair support allows a particularly simple, robust and reliable adjustment of the "pivoting resistance" of the backrest. In this case, the spring element is preferably arranged in the base support or in the direct vicinity of the base support, so that a direct deflection of the spring element may be implemented in a simple manner.

In such a case, a fixed leg spring is preferably used, the one leg thereof being driven by the base support which moves when a load is applied to the seat support or by the fixed chair column, whilst the other leg is supported on the mechanism such that a pivoting of the backrest is only possible counter to the spring element provided with a greater pretensioning, in other words the "pivoting resistance" increases by the coupling of one leg.

In one embodiment of the invention, the other leg may in this connection act directly on the backrest support itself. Such an embodiment is able to be applied particularly advantageously in an asynchronous mechanism in which only the backrest pivots, whilst the seat support is fixed. The invention may, however, in a further embodiment also be designed such that the other spring leg is supported on the seat support which is pivotably connected to the backrest support. This design is able to be used particularly advantageously in a synchronous mechanism, in which the seat support may be pivoted to the rear in synchronism with the backrest support, and the spring arrangement is configured for acting on the synchronous mechanism counter to the synchronous movement thereof by the seat support and backrest support. Naturally, however, even in the case of a synchronous mechanism, the other leg may be supported on the backrest support.

With an indirect impingement of the spring element of the spring arrangement by the base support which moves relative to the chair column, preferably a transmission means may be used, cooperating with the moving unit, in particular the base support, by which the weight of the user is transmitted to the spring element. Transmission means in the form of tractive means, such as a control cable or Bowden cable, levers and belts, in particular toothed belts, have proved particularly advantageous. Thus the displacement of the moving unit caused by the weight of the user may also be used to influence spring elements arranged remotely from the base support.

It is, for example, quite particularly advantageous if the pretensioning of a helical compression spring is increased via a control cable fastened to the fixed chair column and driven by the moving base support, which is supported on the seat support of a synchronous mechanism counter to the pivoting movement of the backrest. Preferably, the control cable is guided in this case from the base support to the spring element via corresponding rollers, which prevent mechanical wear of the control cable and at the same time allow an adjustment of the spring pretensioning in a particularly friction-free manner. At the same time, the control cable is arranged such that it preferably extends entirely in the housing of the base support and/or seat support and thus is not visible from the outside. Thus, not only soiling of the control cable is avoided thereby. Also, a concealed control cable guide is recommendable for reasons of safety. Moreover, the concealed arrangement of the control cable is also advantageous from an aesthetic perspective.

In a further particularly advantageous embodiment of the invention, the spring rate is adjusted by means of a transmission means in the form of a slotted guide, in which a pin is guided and/or held, which in turn is connected to spring elements, such as for example tension springs.

In summary, the invention relates to the automatic adjustment of the "pivoting resistance" of the backrest, which—by the user himself or herself applying a load to the office chair—may take place either by adjusting the pretensioning or by adjusting the spring rate of the spring arrangement of the mechanism or by a combination of both adjustment options. The structural and functional details disclosed here relative to the adjustment of the pretensioning of the spring arrangement may, in other words, also be associated with the structural and functional details disclosed here relative to the adjustment of the spring rate of the spring arrangement, so that an automatic adjustment of the "pivoting resistance" of the backrest may also be carried out by a combination of both adjusting options. By means of such a combination, the advantages of both techniques may be combined in a simple manner and possible drawbacks of one and/or the other technique may be avoided.

Moreover, the invention also discloses a safety device for an office chair, by which an inadvertent adjustment of a spring arrangement adjusted by the weight of the user by pivoting the backrest support, is effectively avoided.

Embodiments of the invention are described in more detail hereinafter with reference to the drawings, in which:

Figure 1:
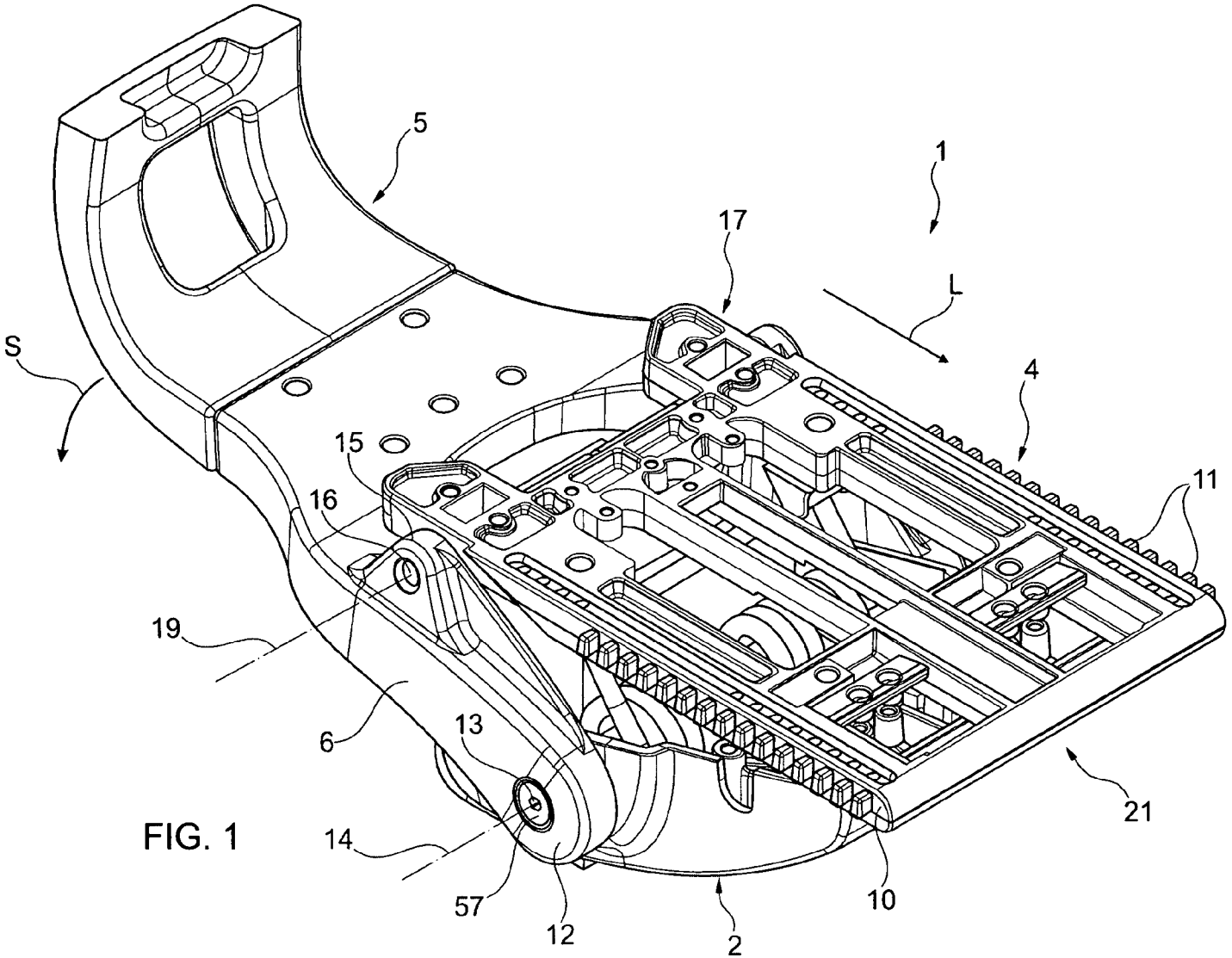
FIG. 1 shows a perspective view of a first synchronous mechanism.

All the figures show the invention merely schematically and with the essential components thereof.

A first embodiment of the invention which shows the adjustment of the pretensioning of a spring arrangement, is shown in FIGS. 1 to 4. A synchronous mechanism is substantially used as a basis for the mechanism described below, as is disclosed in the German patent DE 10 2005 003 383. The contents of this printed patent specification are hereby fully incorporated in the present description.

DESCRIPTION OF THE INVENTION

The synchronous mechanism 1 has a base support 2 which, in a manner described in detail below, is connected to the upper end of a chair column (not illustrated). The synchronous mechanism comprises a substantially frame-shaped seat support 4 and a backrest support 5 which is fork-shaped in plan view, the cheeks 6, 7 thereof being arranged on both sides of the base support 2. Moreover, the synchronous mechanism comprises a spring arrangement described in detail further below, for acting on the mechanism counter to the movement of the backrest support 5.

The seat (not shown) provided with an upholstered seating surface is mounted on the seat support 4. On the lateral frame elements 10 of the seat support 4, a number of latching lugs 11 are provided, arranged in succession in the longitudinal direction of the chair L, which in a manner known per se and not described in more detail are used for positioning and fastening the seat to the seat support 4.

A backrest which is not shown in more detail is attached to the backrest support 5, and which is height-adjustable in modern office chairs. The backrest may also be integrally connected to the backrest support 5.

Figure 2:
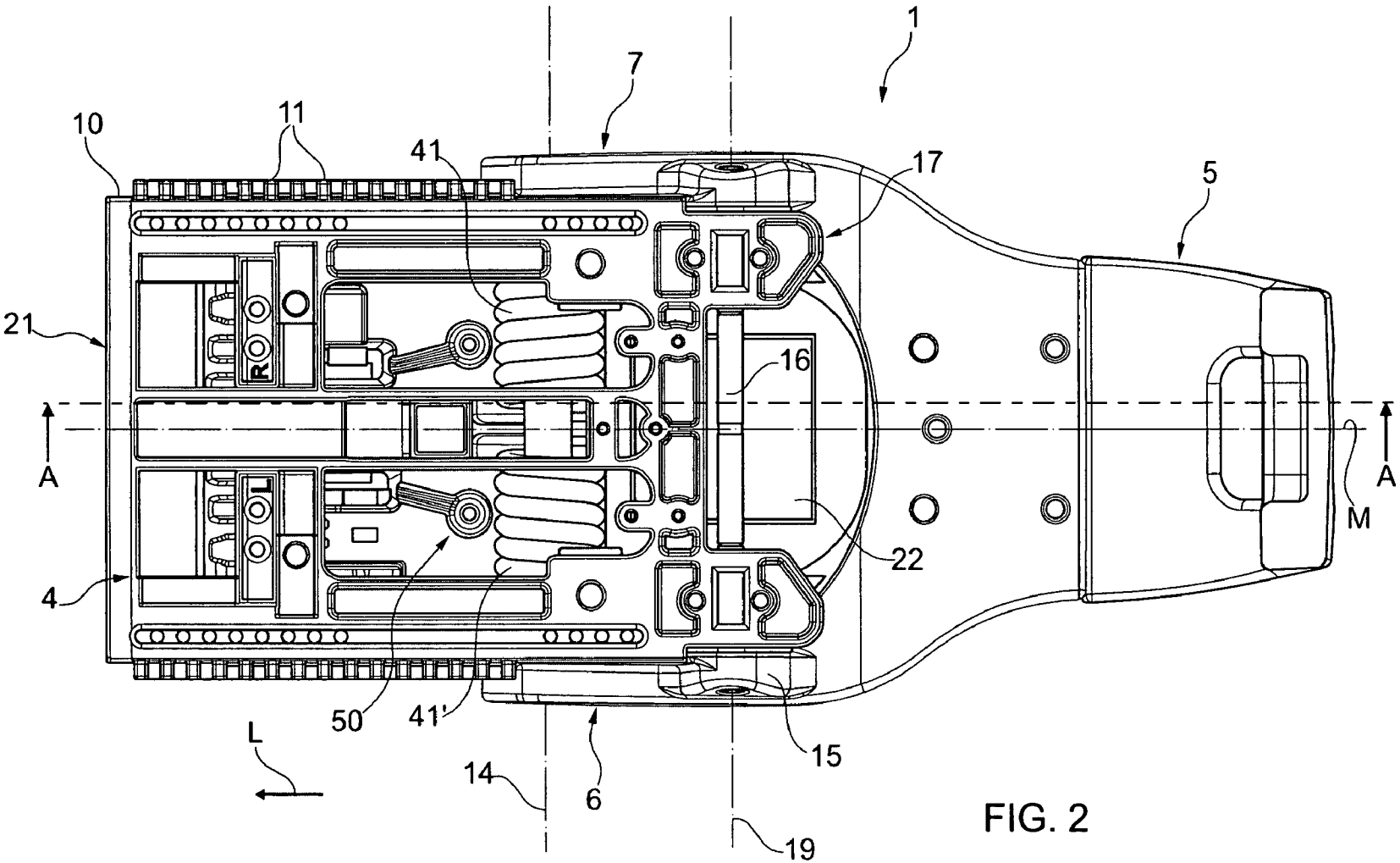
FIG. 2 shows a first synchronous mechanism in plan view.

The entire synchronous mechanism 1, as regards the actual kinematics, is of mirror-symmetrical construction relative to the central longitudinal plane M (see FIG. 2). In this respect, the following description is always based on structural elements of the actual pivoting mechanism which are present in pairs on both sides.

The backrest support 5 is, on the one hand, directly connected to the base support 2 in an articulated manner by the lower end 12 of the cheek 6 which is oriented to the front, namely mounted on a pivot pin 13 on the base support 2 such that the backrest support 5 is approximately centrally articulated via the pivot pin 13 directly on the base support 2. As a result, the backrest support 5 may be pivoted with the backrest in the pivoting direction S, about the central longitudinal axis 14 extending through the pivot pin 13. On the other hand, the backrest support 5 is connected by the upper end 15 of the cheek 6 via a joint 16 to the seat support 4 at the rear end region 17 thereof. By pivoting the backrest, therefore, the seat support 4 is also driven and lowered in the pivoting direction S. In other words a pivoting takes place about the joint axis 19 of the joint 16. The geometry of the pivoting mechanism used has the advantage that a high down-tilt angle of the seat support 4 may be achieved, without the pivoting angle of the backrest having to be too great, which might lead to a position similar to a reclining position. Thus the so-called "riding-up effect" of clothes is effectively avoided.

The seat support 4 is at its front end region 21 connected to the base support 2 via a turning-and-sliding joint (not shown in detail). For designing the turning-and-sliding joint—and for further structural details of the mechanism—reference is made to the contents of the printed patent specification DE 10 2005 003 383.

Due to the shape of the backrest support 5 and the arrangement thereof on the base support 2 and the seat support 4, when loading the backrest, on the one hand, the backrest support 5 carries out a pivoting motion S downward to the rear. As a result of the pivoting motion, however, the seat support 4 is also pivoted downward to the rear and also horizontally displaced to the rear in the region of the turning-and-sliding joint. As a result, no significant lifting motion of the front end of the seating surface is produced, whereby the underside of the thigh is prevented from being trapped.

The synchronous mechanism 1 is pretensioned by a spring arrangement counter to the pivoting direction S—i.e. towards the initial position of the synchronous mechanism. This spring arrangement 50 is provided in the form of two leg springs 41, 41' aligned with one another in the transverse direction. The leg springs 41, 41' are positioned around the pivot pin 13. The leg facing upwards 42 is supported on a prismatic guide 55, which is arranged on the underside 31 of the seat support 4, whilst the second leg 43 extending to the rear, is supported in an adjusting mechanism according to the invention in the base support 2. The leg springs 41, 41' exert a spring force counter to the pivoting motion S of the backrest oriented to the rear, which may be varied by the adjusting mechanism.

The adjusting mechanism is substantially formed by a vertical linear guide 30, which is designed as part of the base support 2. The linear guide 30 comprises a square guide opening 22 arranged in the base support 2 as well as a correspondingly formed guide element 23 located in the guide opening 22. The guide opening 22 is formed in this connection by suitable sub-elements 24 of the base support 2. The guide opening 22 and/or guide element 23 may also have different cross sections in other embodiments of the invention. On the underside 25 of the guide element 23, a conical receiver 3 is provided for fastening the upper end of the chair column. In other words, the chair column and the guide element 23 in the assembled state form a sub-assembly, which is fixedly located in the guide opening 22 of the base support 2.

The diameter of the guide opening 22 is enlarged on its side facing in the direction of the seat support 4, so that a stop 26 is formed in the guide opening. In the unloaded state of the seat support 4, the guide element 23 bears against the stop 26 with its upper end 27 which is provided with an enlarged diameter, see FIG. 3.

The guide element 23 has a horizontally extending transverse opening 28 in which the leg 43 extending to the rear of the leg spring 41 is located, and is mounted and supported there on guide elements/mounting elements 29 provided in the transverse opening 28. The pivot pin 13 and the linear guide 30 are in this case positioned in the vicinity of one another such that the leg 43 in the assembled state may easily pass through a through-opening 32 provided accordingly in the sub-element 24 of the base support 2, and may be located in the transverse opening 28.

Figure 3:
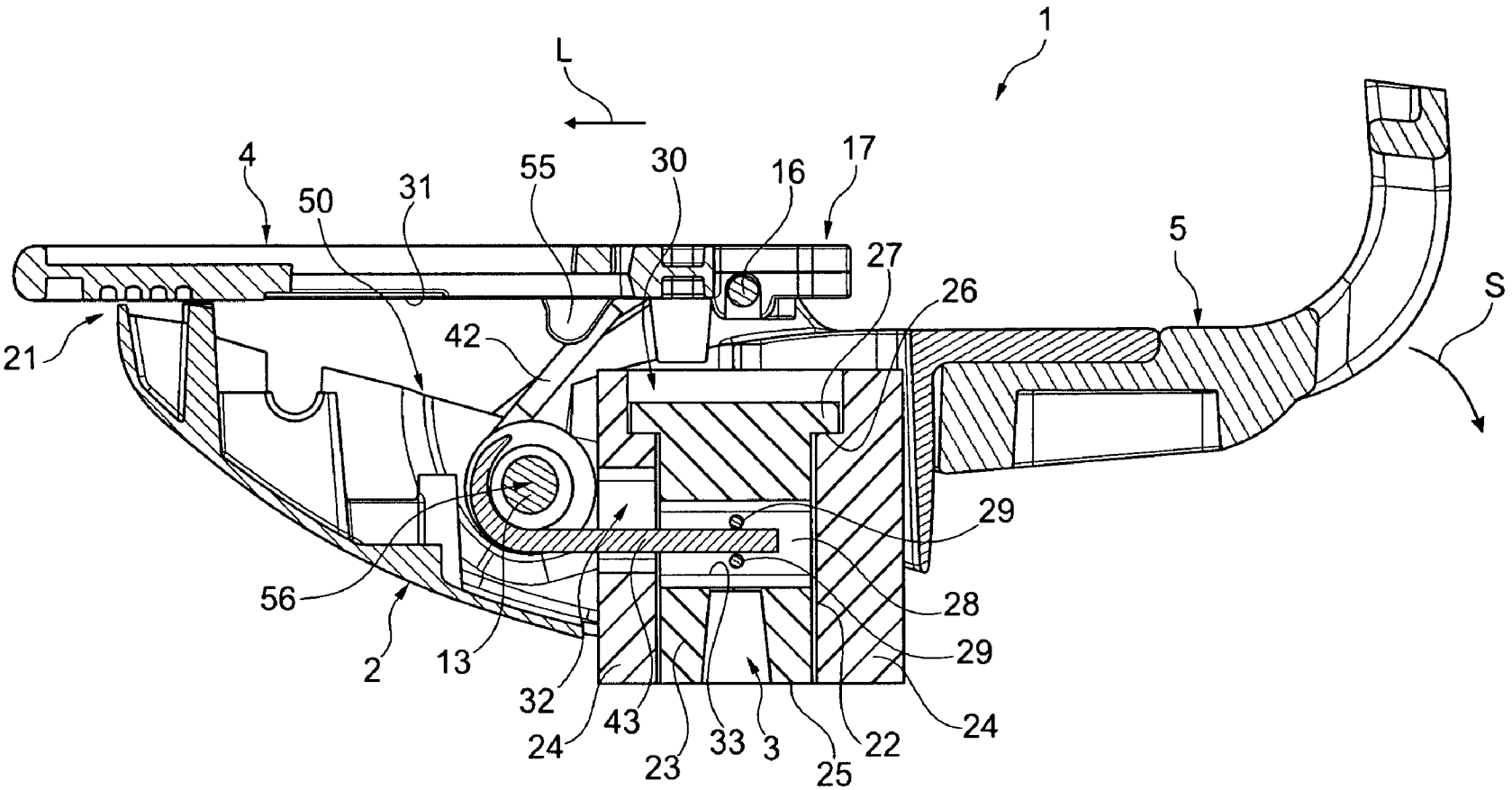
FIG. 3 shows a sectional view of a first synchronous mechanism in the partially loaded state (along the line AA in FIG. 2)

In the unloaded state of the seat support 4, the leg 43 extends slightly inclined downward from the horizontal through the through-opening and transverse opening 28, 32 (not illustrated). In a partially loaded state of the seat support 4, as illustrated in FIG. 3, the leg 43 extends substantially horizontally and thus approximately parallel to the underside 33 of the transverse opening 28 of the guide element 23, without mechanical contact with the through-opening or transverse opening 28, 32. If a full load is applied to the seat support 4 by a user having sat down on the office chair, the moving unit formed from the seat support 4 and base support 2 is moved downwards as a whole in the direction of movement, namely on a common path of motion, namely a vertically extending straight line 18, relative to the fixed sub-assembly made up of the chair column and the guide element 23. The relative motion of the moving unit to the chair column takes place, in this case, without the position of the seat support 4 and base support 2 being altered relative to one another. The friction occurring with the relative movement between the guide element 23 and the guide opening 22, is in this case reduced by the use of ball bearings, guide rings, slide bushes or the like (not illustrated).

The spring leg 43, extending to the rear, of the leg spring 41 is driven from the underside 33 of the transverse opening 28 and forced upward, i.e. deflected upward from the horizontal, which leads to an increase in the pretensioning of the leg spring 41. This has the result that the pivoting motion of the seat support 4 and the backrest support 5 takes place in the pivoting direction S against a greater resistance.

Due to the loading of the seat support 4 by the user, therefore, initially an adjustment of the pivoting resistance takes place independently of a pivoting motion of the backrest. However, in the present mechanism it is also provided that the pivoting resistance is altered by the pivoting of the backrest itself.

As the leg spring 41 is floatingly mounted on both sides, when the seat support 4 is pivoted downward to the rear, i.e. in the pivoting direction S, the point of articulation of the upper spring leg 42 is displaced. The position of the point of articulation is thus altered when a load is applied to the backrest such that the point of articulation is displaced in the direction of the spring center point 56. As a result, an automatic alteration to the spring behavior of the leg spring 41 additionally takes place with a movement in the pivoting direction S. In other words, when the seat is pivoted, the leg spring 41 and thus the seat as a whole automatically become more rigid.

The backrest support 5 is fastened with fastening screws 57 to the central pivot pin 13. In other words, during the pivoting motion, the pivot pin 13 rotates with the backrest support 5. The diameter of the pivot pin 13 is selected such that the leg springs 41, 41' in the clamped position do not bear against the pivot pin 13. The internal diameter of the leg springs 41, 41' is always greater than the diameter of the pivot pin 13. As a result, an unhindered rotation of the pivot pin 13 is ensured when the seat is pivoted. Additionally, unpleasant contact noise, such as for example squeaking, is avoided. As the two leg springs 41, 41' fitted onto the pivot pin 13 are located with their periphery in a spring support (not illustrated) formed in the manner of a prism, the positioning of the leg springs 41, 41' in their operating position is, nonetheless, reliably ensured.

A second embodiment of the invention, which shows the adjustment of the pretensioning of a spring arrangement, is shown in FIGS. 5 to 9. As a basis for the subsequently disclosed mechanism, a synchronous mechanism is substantially used as is disclosed in the European patent EP 1 396 213. The contents of this printed patent specification are thus entirely incorporated in the present description.

As a supporting part of the synchronous mechanism 1', a base support 2' is provided which in the region of its rear end 34, in a manner disclosed below in detail, is connected to the upper end of a chair column (not illustrated).

Further basic components of the synchronous mechanism 1' are the backrest support 5' and the seat support 4'. The backrest support 5' in the region of the rear end 34 of the base support 2' is pivotably mounted via a transverse shaft 35 on the base support 2'. The backrest support 5' consists of two side struts 36, 37 extending obliquely upward to the rear, which form the connection to the actual backrest (not shown). In the front end region 58 of the base support 2', two upwardly projecting bearing posts 38, 39 are formed on both sides of the central longitudinal plane M, in which a transverse shaft 40, not illustrated in detail, is rotatably mounted.

The substantially plate-shaped seat support 4', in the region of its front end has a slot (not shown), by which the seat support 4 rests on the transverse shaft 40. As a result, a turning-and-sliding joint is formed between the base support 2' and seat support 4', i.e. the seat support 4' may pivot about the transverse shaft 40, and at the same time move relative thereto in the direction of the slots. For the design of the turning-and-sliding joint, —and for further structural details of the mechanism—reference is made to the contents of the printed patent specification EP 1 396 213.

In the region of its rear-facing end, the seat support 4 forms together with a corresponding upwardly projecting bearing projection 8, 9, on the two side struts 36, 37 of the backrest support 3, a pivot bearing about a transverse shaft 41.

For acting on the synchronous mechanism 1' counter to the synchronous adjusting motion, from the initial position shown in the figures, a spring arrangement 43 is provided which has four helical compression springs 44 arranged parallel to one another, in a common horizontal plane on both sides of the central longitudinal plane M. In this connection, for each helical compression spring 44, one respective abutment extension arm 45 is provided, the front end thereof being pivotably articulated relative to the base support 1 via a bearing head 46. The rod-shaped shaft of the abutment extension arm 45 projects freely to the rear. The rear end of the helical compression springs 44 is supported on an adjusting strip 59 described in more detail further below.

The front end of the helical compression springs 44 is located on a supporting strip 48, which extends transversely to the seat longitudinal direction L and horizontally and which is semi-circular in cross section, in the manner of abutments which are supported with their front-facing semi-circular peripheral surface in corresponding internal cylindrical bearing recesses 49 on the seat support 4'.

The compressive force of the helical compression springs 44 clamped and pretensioned between the adjusting strip 59 and the supporting strip 48, urges the seat support 4' forward relative to the base support 2' into the initial position shown. The backrest support 5' is in this case in its maximum upright position.

If the pretensioning of the helical compression springs 44 is to be altered, the adjusting mechanism which has already been disclosed in connection with the first embodiment, is used again. Also in this case, said adjusting mechanism is substantially formed from a vertical linear guide 30' as part of the base support 2', said linear guide comprising a cylindrical guide opening 22' arranged in the base support 2', as well as a guide element 23' located in the guide opening 22'. The guide opening 22' is in this case again formed by suitable corresponding sub-elements 24' of the base support 2'. On the underside 25' of the guide element 23' a conical receiver 3' is provided for fastening the upper end of a chair column, so that the chair column and guide element 23' in the assembled state form a sub-assembly, which is fixedly located in the guide opening 22' of the base support 2'.

Figure 7:
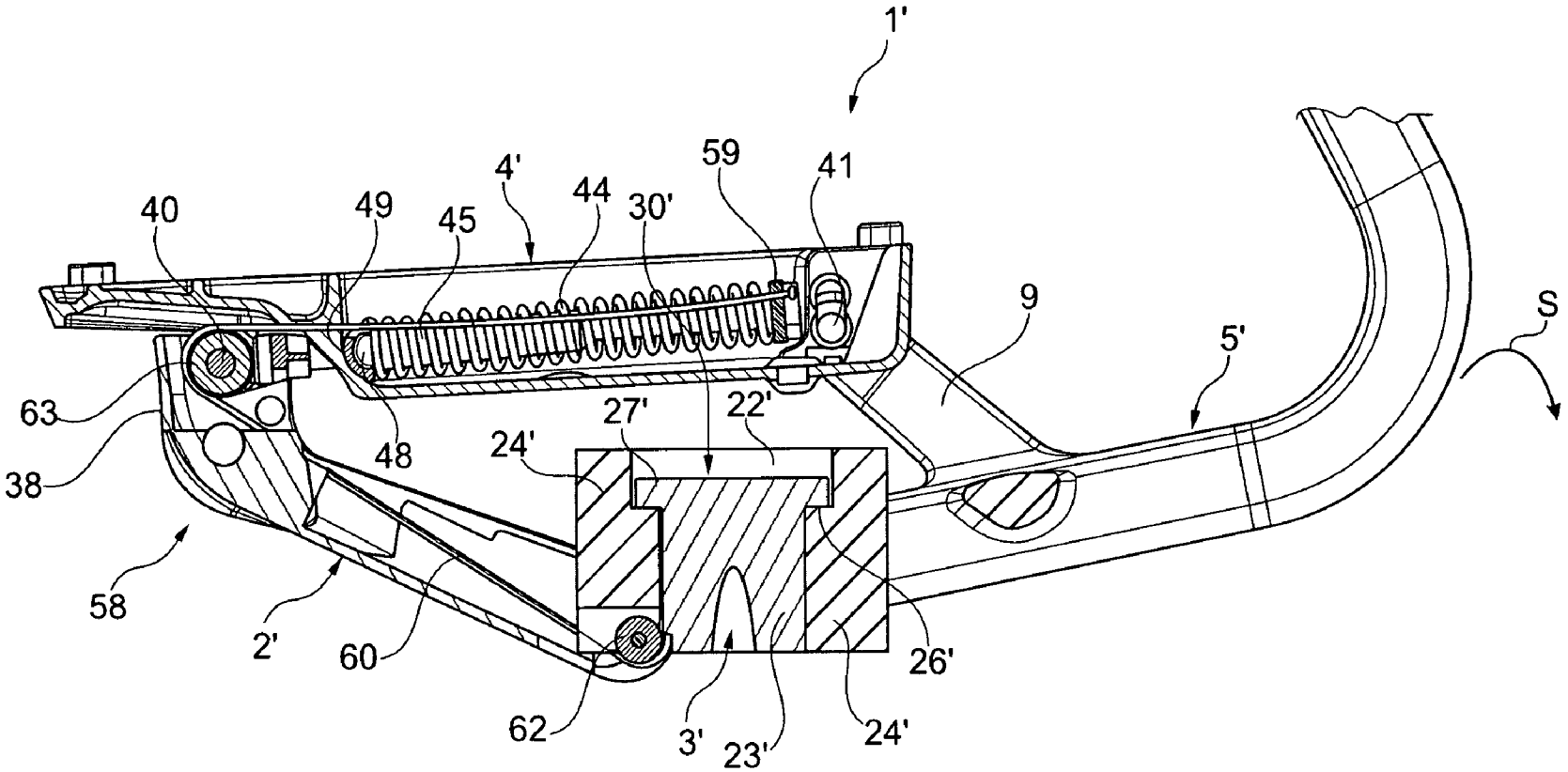
FIG. 7 shows a sectional view of a second synchronous mechanism in the unloaded state (along a line displaced from the inside to the outside within the mechanism)
Figure 8:
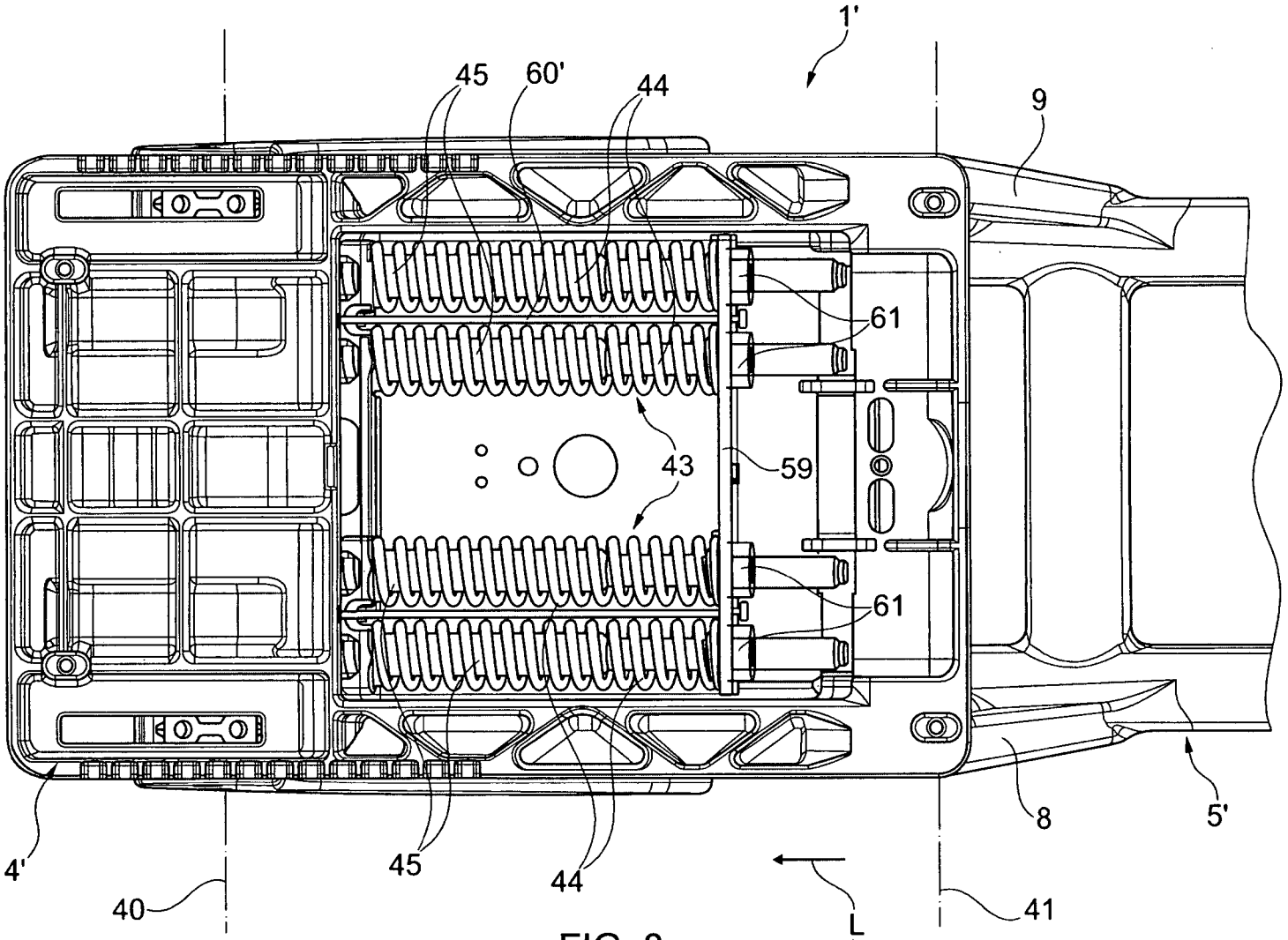
FIG. 8 shows a second synchronous mechanism in the loaded state in plan view.

As shown in FIG. 7, in the unloaded state of the seat support 4' the guide element 23' bears with its upper end 27', provided with an enlarged diameter, against a stop 26' formed in the guide opening 22' which is formed by the diameter of the guide opening 22' being enlarged on its side facing in the direction of the seat support 4'.

The adjusting mechanism thus comprises two control cables 60, 60' serving as transmission means for transmitting the weight of the user to the helical compression springs 44. The control cables 60, 60' are fastened with one end thereof to the guide element 23' which is fixed to the chair column and with the other end thereof to the adjusting strip 59. The adjusting strip 59 serves for supporting the rear ends of the helical compression springs 44 and is provided with four openings 61, through which the shafts of the abutment extension arms 45 pass. In other words, the adjusting strip 59 is displaceably attached to the shafts. The control cables 60, 60' extend spaced apart from one another and in the region of the spring arrangement 43 parallel to the helical compression springs 44, in order to achieve a displacement of the adjusting strip 59 which is as uniform as possible.

Each control cable 60, 60' is arranged such that it leaves the guide opening 23' downward in the direction of the relative motion of the moving unit, and subsequently partially encompasses at least one sub-element of the base support 2' arranged adjacent to the guide opening 22', in other words, extends beyond a sub-element of the base support 2'. This sub-element is preferably a guide pulley 62, so that the mechanical friction and thus the wear of the control cables 60, 60' is only very slight. The control cable 60, 60' extends from the guide pulley 62 arranged on the guide opening 22' and then to a further guide pulley 63 in the front end region 58 of the base support 2', the guide pulley 63 in the embodiment shown being fastened to the transverse shaft 11. From there the control cable 60, 60' extends directly to the adjusting strip 59, to which it is connected.

Figure 9:
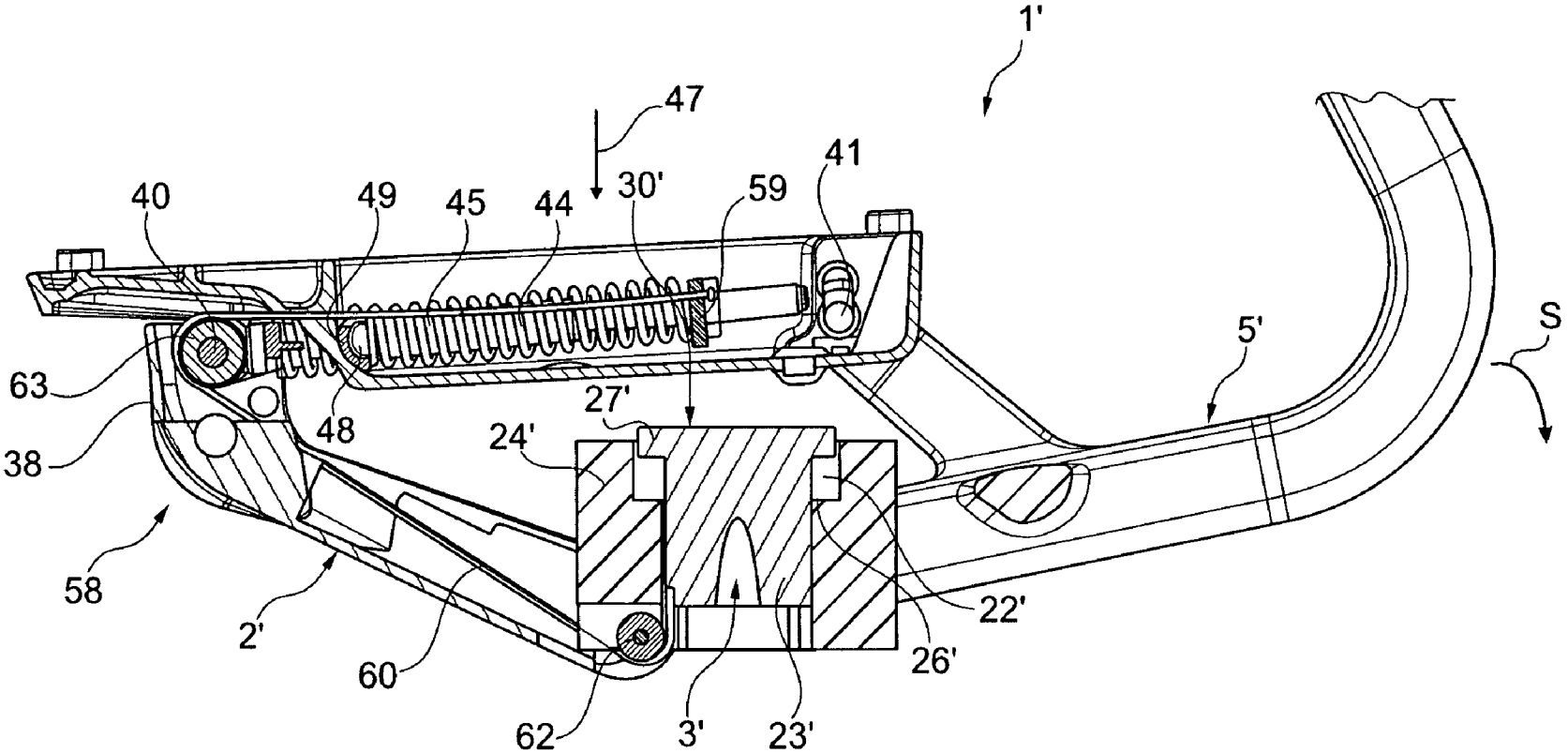
FIG. 9 shows a sectional view of a second synchronous mechanism in the loaded state (along a line displaced from the inside to the outside within the mechanism)
Figure 10:
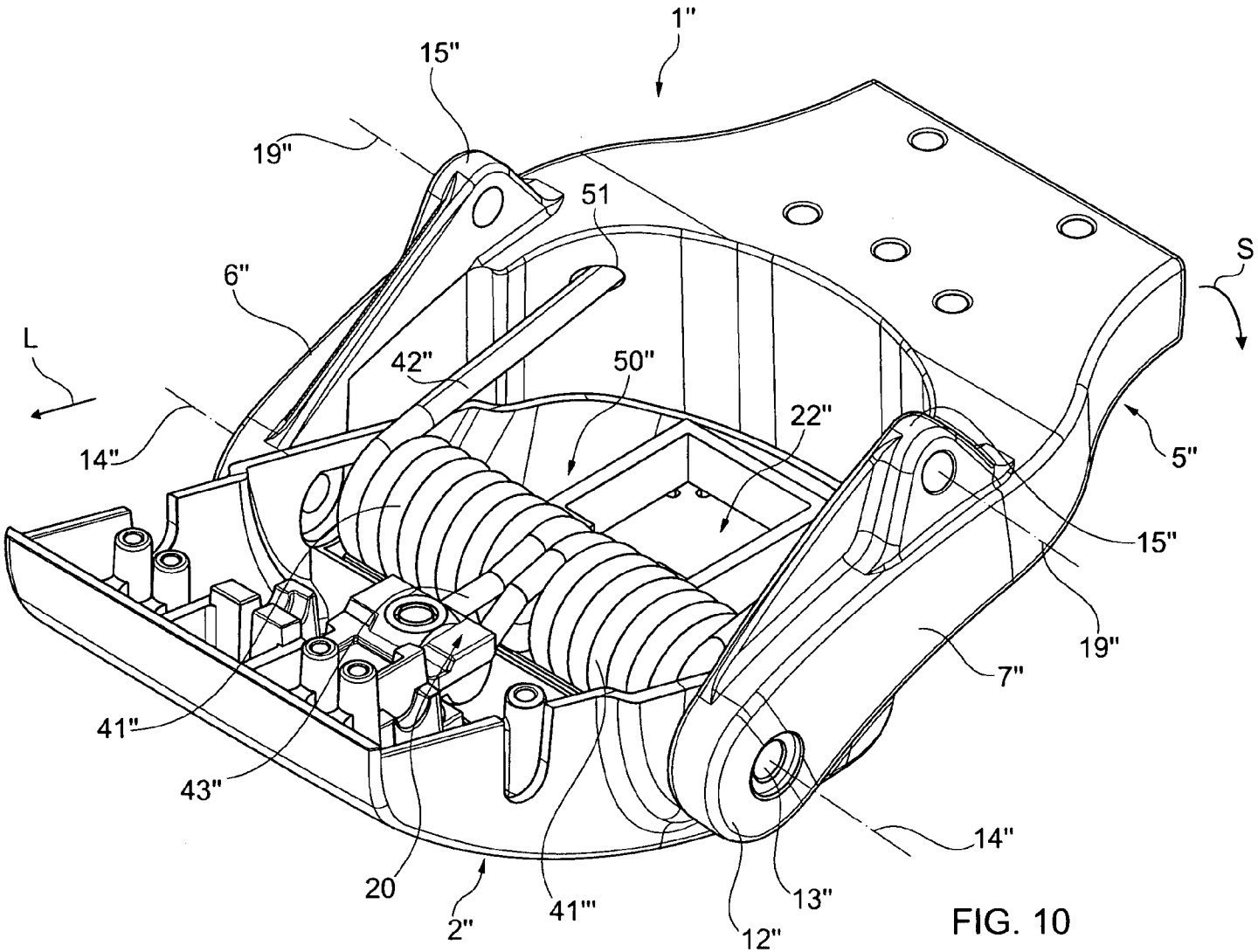
FIG. 10 shows a perspective view of a third synchronous mechanism.

If a load is applied to the seat support 4' by a user sitting down on the office chair, as is indicated in FIG. 9 by the arrow 47, the moving unit formed from the seat support 4' and base support 2', is moved as a whole downward in the direction of movement, and namely on a common path of motion, namely a vertically extending straight line 47 relative to the fixed sub-assembly made up of the chair column and guide element 23'. The relative motion of the moving unit to the chair column takes place, therefore, without the position of the seat support 4' and the base support 2' being altered relative to one another.

As, together with the base support 2', the guide pulley 62 fastened to the base support 2' is also moved downward in the vicinity of the guide opening 23', the control cable 60, 60' is driven so that the cable length between the guide pulley 62 and the adjusting strip 59 is reduced. As a result, the adjusting strip 59 is displaced on the shafts of the abutment extension arms 45 in the direction of the supporting strip 48, whereby the helical compression springs 44 are compressed to a greater degree and a greater compressive force is exerted on the supporting strip 48 and thus on the seat support 4'. As a result of the increased pretensioning of the helical compression springs 44, when a load is applied to the backrest, the pivoting motion S of the seat support 4' and backrest support 5' takes place in the pivoting direction S against a greater "pivoting resistance".

As a result of the loading of the seat support 4' by the user, therefore, in this embodiment initially an adjustment of the pivoting resistance also takes place independently of a pivoting motion of the backrest. However, it is also provided in the present mechanism that the pivoting resistance is altered by the pivoting of the backrest itself.

When pushing back the backrest, the backrest support 5' is namely pivoted to the rear. Said backrest support therefore pivots the seat support 4' downward to the rear around the turning-and-sliding joint in the front region of the seat support 4'. At the same time, the supporting strip 48 is displaced closer to the end of the abutment extension arms 45, so that the helical compression springs 44 are compressed to a greater degree and thus create a greater counter force. If the backrest is unloaded, the seat support 4' is again pivoted upward to the front by the helical compression springs 44, the backrest support 5' being pivoted at the same time.

A third embodiment of the invention, which shows the adjustment of the pretensioning of a spring arrangement, is shown in FIGS. 10 to 13. The synchronous mechanism already shown in FIGS. 1 to 4 is substantially used as a basis.

The synchronous mechanism 1" has a base support 2" which, in a manner disclosed below in detail, is connected to the upper end of a chair column (not illustrated). The synchronous mechanism comprises a substantially frame-shaped seat support 4" (not illustrated in FIG. 10 for reasons of clarity) and a backrest support 5" which is fork-shaped in plan view, the cheeks 6", 7" thereof again being arranged on both sides of the base support 2". Moreover, the synchronous mechanism comprises a spring arrangement described below in more detail for acting on the mechanism, counter to the movement of the backrest support 5". The seat (not shown) provided with an upholstered seating surface is mounted on the seat support 4".

A backrest, not shown in more detail, which in modern office chairs is height-adjustable, is attached to the backrest support 5". The backrest may be also integrally connected to the backrest support 5".

Figure 11:
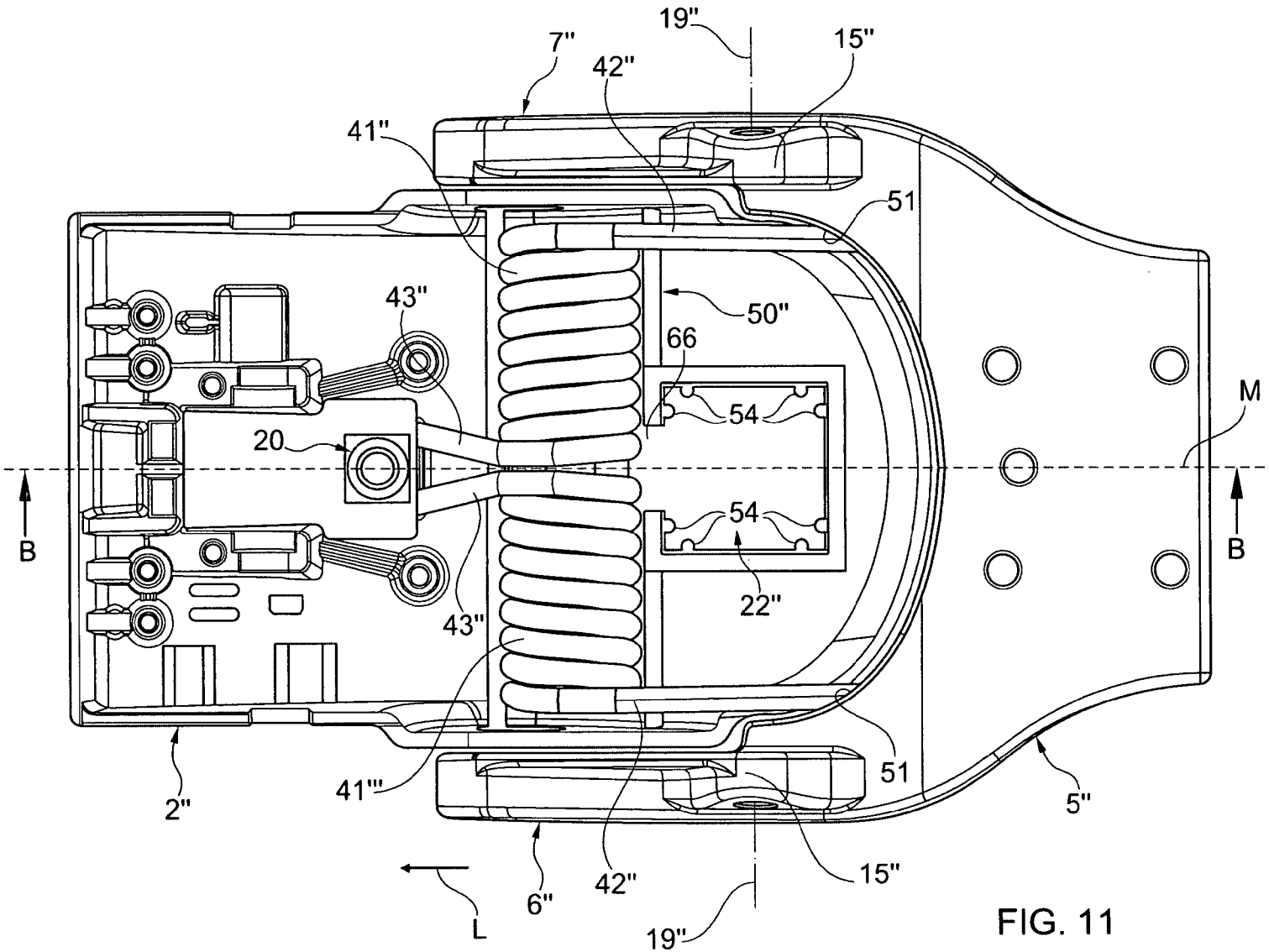
FIG. 11 shows a third synchronous mechanism in plan view.

The entire synchronous mechanism 1", as regards the actual kinematics, is of mirror-symmetrical construction, relative to the central longitudinal plane M (see FIG. 11). In this regard, the following description is always based on structural elements which are present in pairs on both sides of the actual pivoting mechanism.

The backrest support 5" is firstly directly connected in an articulated manner by the lower end 12" of the cheek 7" oriented to the front, to the base support 2", namely mounted on separate pivot elements 13" on the base support 2", such that the backrest support 5" is approximately centrally articulated via the pivot elements 13" directly on the base support 2". As a result, the backrest support 5" may be pivoted with the backrest about the central longitudinal axis 14" in the pivoting direction S extending through the pivot elements 13". Secondly, the backrest support 5" is connected by the upper end 15" of the cheek 7" via a joint 16" to the seat support 4" at the rear end region 17" thereof. By pivoting the backrest, therefore, the seat support 4" is also driven and lowered in the pivoting direction S. In other words, the joint 16" pivots about the joint axis 19". The geometry of the pivoting mechanism used has the advantage that a high down-tilt angle of the seat support 4" may be achieved, without the pivot angle of the backrest having to be too great which might lead to a position similar to a reclining position. Thus the so-called "riding-up effect" of clothes is effectively avoided.

The seat support 4" is at its front end region 21" connected to the base support 2" via a turning-and-sliding joint (not shown in detail). For the design of the turning-and-sliding joint—and for further structural details of the mechanism—reference is made to the contents of the printed patent specification DE 10 2005 003 383 as has already been made with reference to the first embodiment.

Due to the shape of the backrest support 5" and the arrangement thereof on the base support 2" and the seat support 4", when a load is applied to the backrest, the backrest support 5" carries out, on the one hand, a pivoting motion in the pivoting direction S downward to the rear. As a result of the pivoting motion, however, the seat support 4" is both pivoted downward to the rear and also displaced horizontally to the rear in the region of the turning-and-sliding joint. As a result, no significant lifting motion of the front end of the seating surface results, whereby the underside of the thigh is prevented from being trapped.

The synchronous mechanism 1" is pretensioned by a spring arrangement counter to the pivoting direction S—i.e. to the initial position of the synchronous mechanism. This spring arrangement 50" is provided in the form of two leg springs 41", 41'" aligned with one another in the transverse direction. The leg springs 41", 41'" exert a spring force counter to the pivoting motion S of the backrest oriented to the rear, which may be varied by the adjusting mechanism.

The leg 42" of the leg spring 41" facing to the rear, thus extends through a receiver opening 51 in the backrest support 5" and is supported on a prismatic guide (not illustrated) on the backrest support 5", whilst the second leg 43" extending to the front, is supported on a prismatic guide 52. The position of the two prismatic guides 52 may be vertically adjusted by means of a common adjusting mechanism 20, not explained in more detail, via a hand wheel or the like, whereby the pretensioning of the leg springs 41", 41'" may also be manually adjusted, by altering the position of the spring leg 43".

In this third embodiment, therefore, the leg springs 41", 41'" are not positioned about a pivot pin. Instead, they are located in a vertically displaceable holding tray 53, which forms part of the adjusting mechanism of this embodiment. The holding tray 53 forms in this case a receiver for the leg springs 41", 41'" configured in the manner of a prism.

The adjusting mechanism is substantially formed by a vertical linear guide 30", which is designed as part of the base support 2". The linear guide 30" comprises a square guide opening 22" arranged in the base support 2", as well as a guide element 23" located in the guide opening 22". The guide opening 22" is in this case formed by suitable corresponding sub-elements 24" (in this case housing parts) of the base support 2". On the underside 25" of the guide element 23" a conical receiver 3" is provided for fastening the upper end of the chair column. In other words, the chair column and guide element 23" in the assembled state form a sub-assembly which is fixedly located in the guide opening 22" of the base support 2". For secure guidance of the guide element 23" in the guide opening 22", eight vertically extending guide strips 54 are provided in the guide opening 22" which correspond to corresponding guide grooves (not shown) of the guide element 23" see FIG. 11.

The guide element 23" has an arm 64 extending forward out of the guide opening 22" in the direction of the leg springs 41", 41'", in the upper face 65 thereof the holding tray 53, which extends in the transverse direction, being provided for receiving the leg springs 41", 41'". The front sub-element 24" of the base support 2" has to this end a corresponding vertical opening 66.

Figure 12:
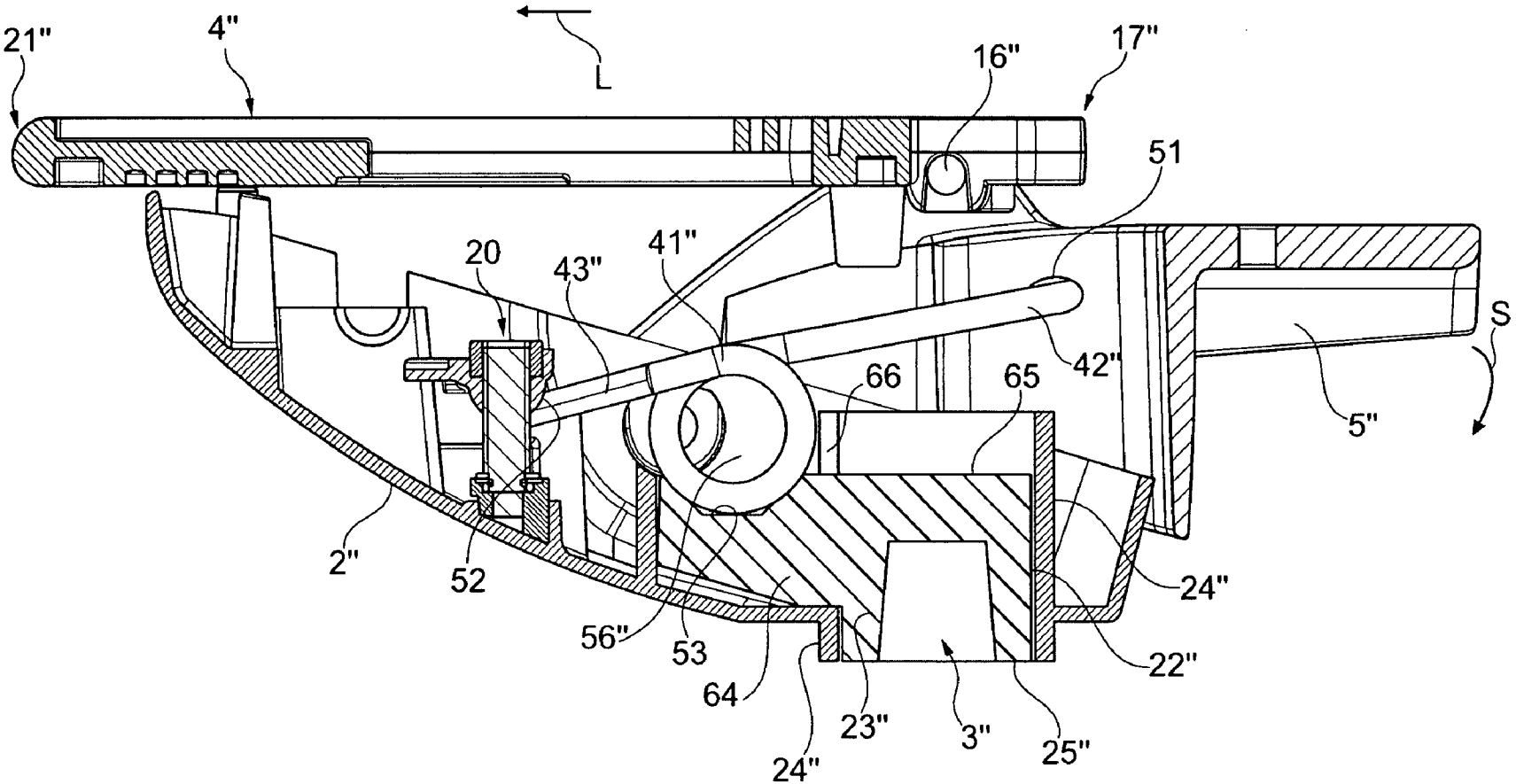
FIG. 12 shows a sectional view of a third synchronous mechanism in the unloaded state (along the line BB in FIG. 11)

In an unloaded state of the seat support 4", as illustrated in FIG. 12, the legs 42", 43" extend substantially in a linear manner, preferably from below at the front to above at the rear, i.e. the prismatic guide 52 is arranged lower down in the synchronous mechanism 1" than the prismatic guide in the backrest support 5" arranged behind the receiver opening 51 (and concealed in the figures). If the seat support 4" is fully loaded as a user has sat down on the office chair, the moving unit, formed from the seat support 4" and base support 2", is as a whole moved downward in the direction of movement, and namely on a common path of motion, namely a vertically extending straight line 18", relative to the fixed sub-assembly consisting of the chair column and the guide element 23", see FIG. 13. The relative motion of the moving unit to the chair column takes place, therefore, without the position of the seat support 4" and the base support 2" being altered relative to one another.

By the relative movement of the guide element 23" to the base support 2" the arm 64 of the holding tray 53 is lifted relative to the remaining mechanism. As a result, the vertical position of the spring center point 56" of the leg springs 41", 41'" is altered both relative to the fixed prismatic guide 52 in the base support 2" and to the fixed prismatic guide in the backrest support 5" arranged behind the receiver opening 51. In other words, a simultaneous pretensioning takes place of both spring legs 42", 43" of the leg springs 41", 41'". This has the result that the resistance against a pivoting motion of the backrest support 5" is markedly increased in the pivoting direction S.

Due to the loading of the seat support 4" by the user, therefore, initially an adjustment of the pivoting resistance takes place independently of a pivoting motion of the backrest. However, in the present mechanism, it is also provided that the pivoting resistance is altered by the pivoting of the backrest itself.

As the leg spring 41" is floatingly mounted on both sides, when pivoting the seat support 4" downward to the rear, i.e. in the pivoting direction S, the point of articulation of the rear spring leg 42" is displaced. The position of the point of articulation thus alters when a load is applied to the backrest such that the point of articulation is displaced in the direction of the spring center point 56". As a result, an automatic alteration to the spring behavior of the leg spring 41" additionally takes place when moving in the pivoting direction S. In other words, when pivoting the seat, the leg spring 41" and thus the seat as a whole automatically become more rigid.

A fourth embodiment of the invention which shows the adjustment of the spring rate of a spring arrangement 75, is shown in FIGS. 14 to 19.

The entire synchronous mechanism 1'" as regards the actual kinematics is again of mirror-symmetrical construction relative to the central longitudinal plane M. In this respect, the following description is always based on structural elements of the mechanism present in pairs on both sides.

As a supporting part of the synchronous mechanism 1'', again a base support 2''' is provided which in the region of its rear end 34' in a manner described in detail below is connected to the upper end of a chair column (not illustrated). Further basic components of the synchronous mechanism 1''' are the backrest support 5''' and the seat support 4'''.

The backrest support 5''' consists of two side struts 36', 37' extending to the rear, which form the connection to the actual backrest (not shown).

In the region of its rear end the seat support 4''' forms, together with a corresponding upwardly projecting bearing projection 8', 9' on the two side struts 36', 37' of the backrest support 3''', a pivot bearing about a transverse shaft 41'. The pivot bearing is in this case arranged behind the connection with the chair column.

Two upwardly projecting bearing posts 39' are formed just in front of the front end region 58' of the base support 2''' on both sides of the central longitudinal plane M. The bearing posts 39' form with the front regions of the substantially plate-shaped seat support 4''' a turning-and-sliding joint (not shown in detail) whereby a movement of the seat support 4''' is possible to the rear. For the design of the turning-and-sliding joint, reference is made to the contents of the printed patent specification DE 10 2005 003 383. Via the transverse shaft 41', on the one hand, and the turning-and-sliding joint, on the other hand, the seat support 4''' when pivoting the backrest support 5''' is pivoted therewith to the rear.

The two side struts 36', 37' of the backrest support 5''' are extended to the front beyond the bearing projections 8', 9' and pivotably mounted on the base support 2''' in the region in front of the conical receiver 3''' via a transverse shaft 35'.

Figure 17:
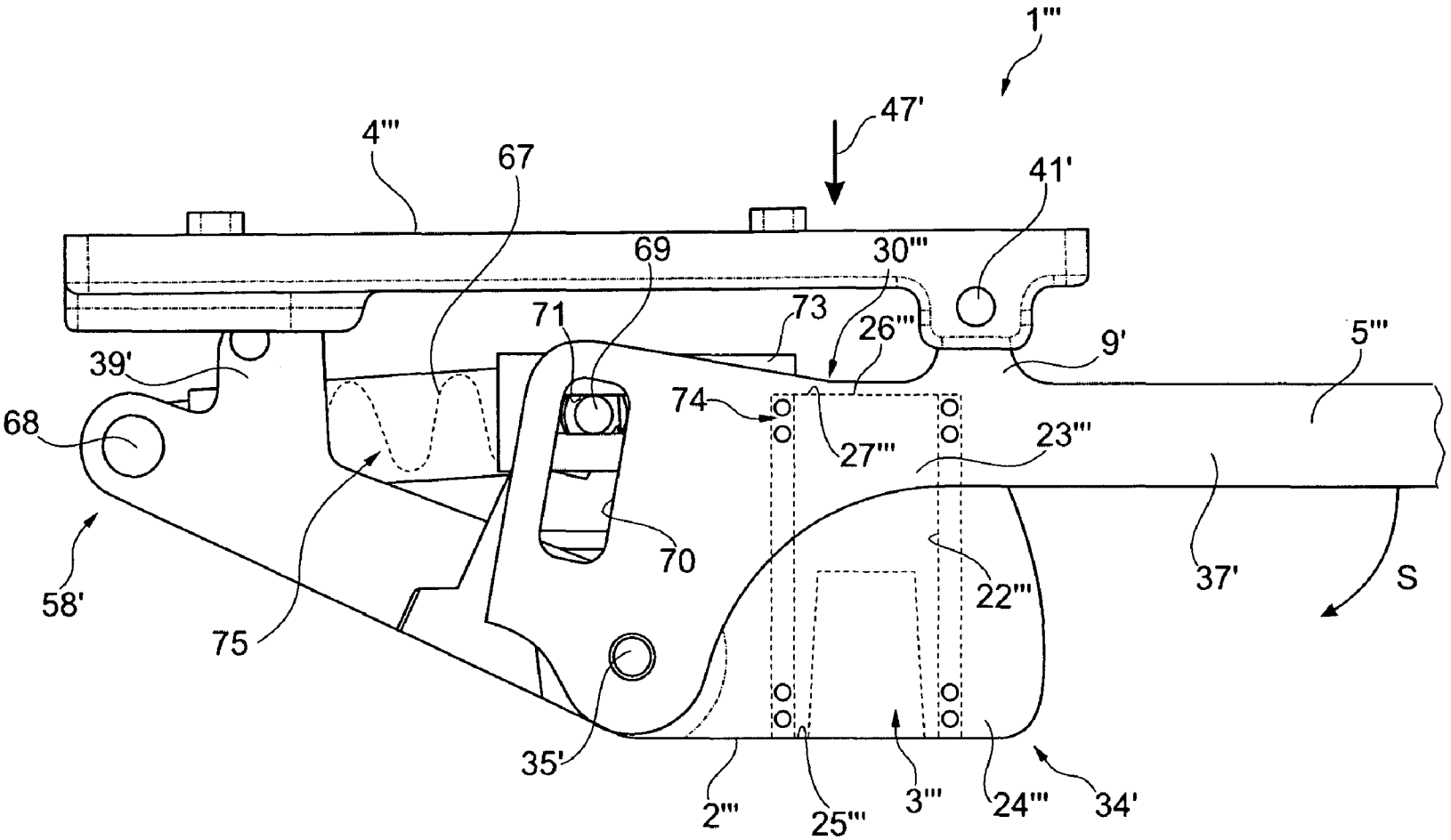
FIG. 17 shows a sectional view of a fourth synchronous mechanism in the loaded and unpivoted state (along the line AA in FIG. 14)
Figure 18:
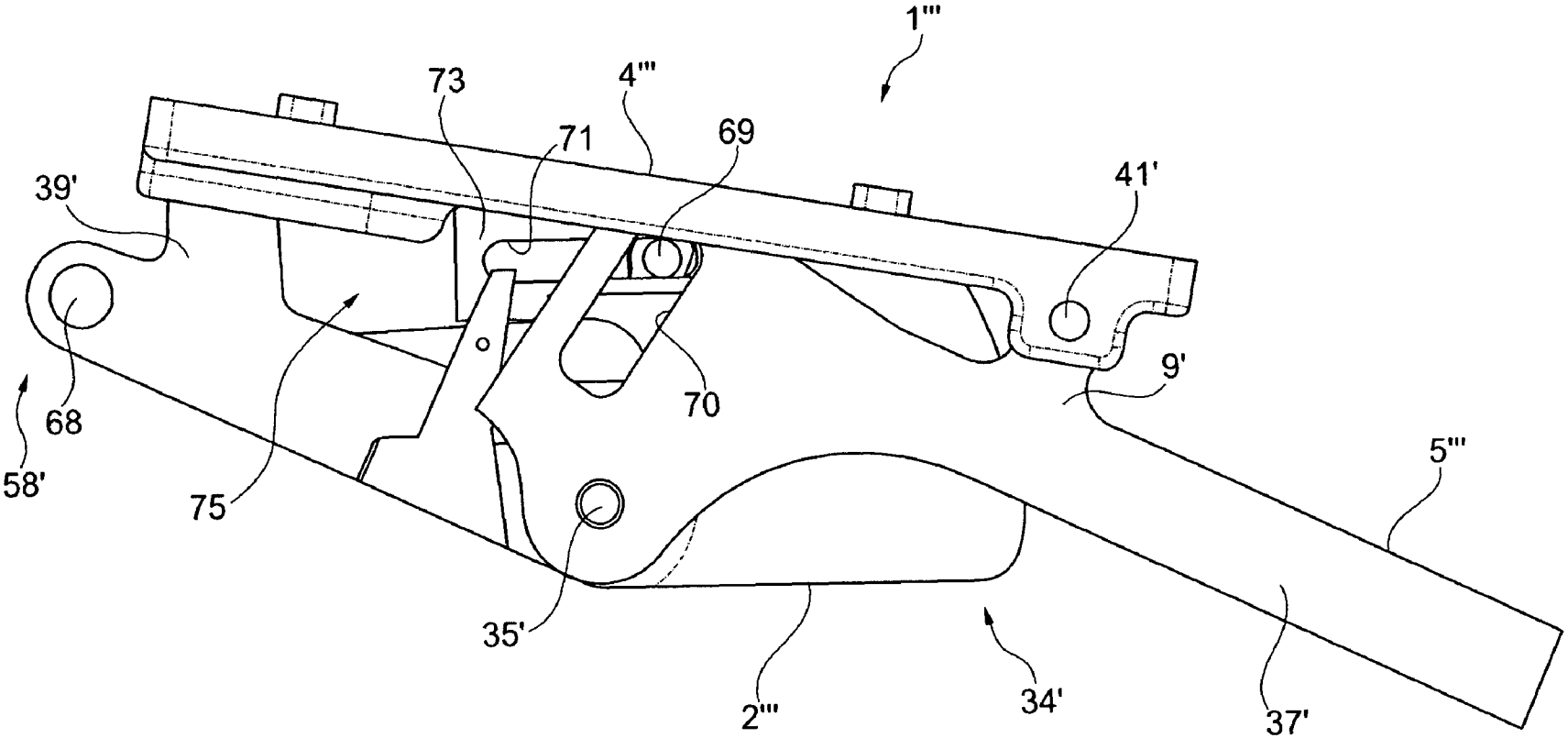
FIG. 18 shows a sectional view of a fourth synchronous mechanism in the loaded and pivoted state (along the line AA in FIG. 14)
Figure 19:
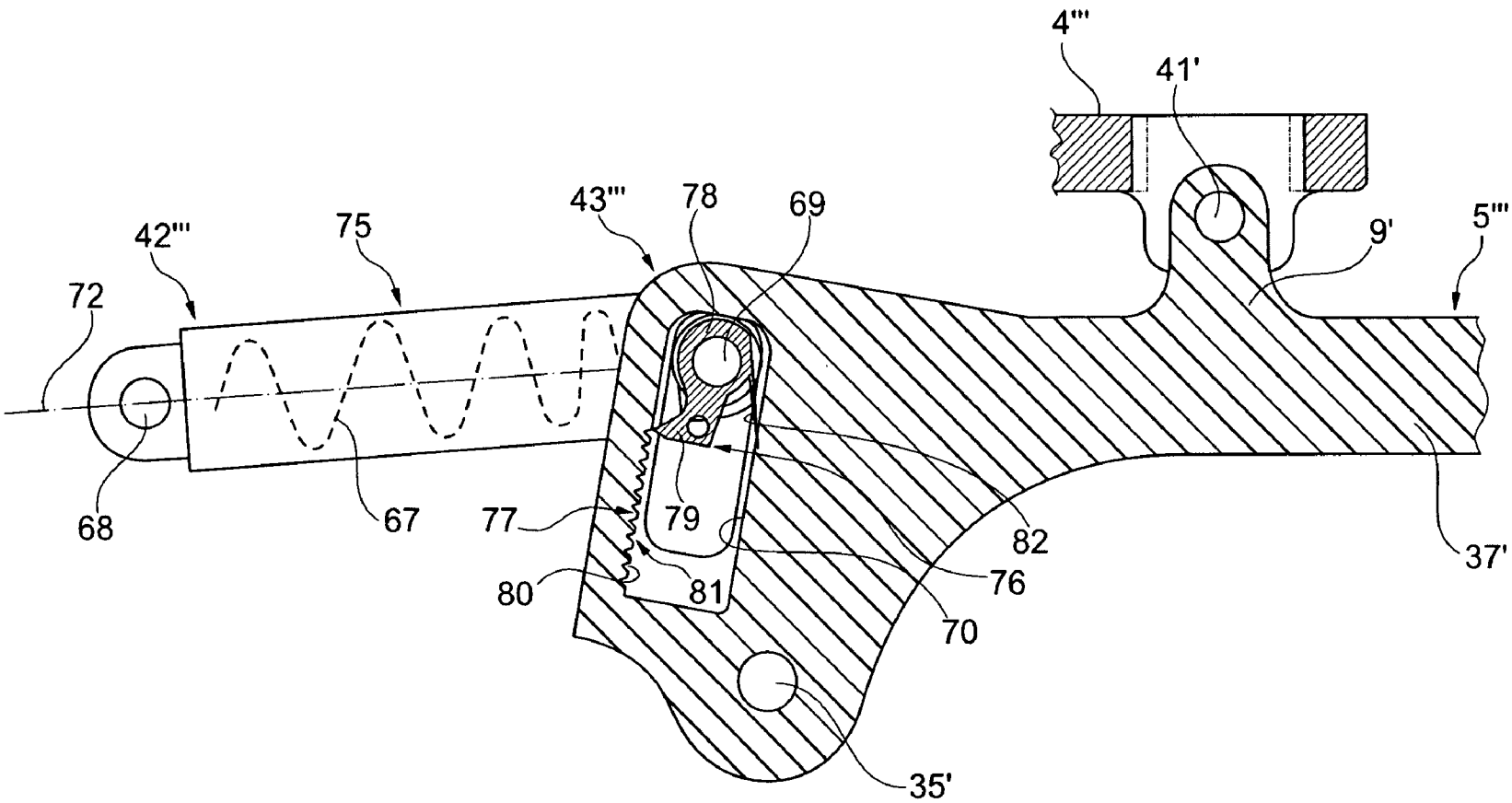
FIG. 19 shows a partial sectional view of a fourth synchronous mechanism in the loaded and unpivoted state (along the line AA in FIG. 14)

For urging the synchronous mechanism 1''' out of the initial position into a pivoted position, a spring arrangement 75 is provided which has two tension springs 67 parallel to one another and arranged on both sides of the central longitudinal plane M in a common horizontal plane (symbolized in FIGS. 17 and 19). The tension springs 67 are in this case suspended with their ends 42''', 43''' respectively on transverse axes 68, 69 and connected thereto. The one transverse shaft 68 is located fixedly in the front end region 58' of the base support 2'''. The other transverse shaft 69 is movable and is held by the cooperation of two linear guides in a working position. The linear guides are slot-like slotted guides 70, 71. The tension springs 67 are in this case pretensioned toward the initial position of the synchronous mechanism. The position of the tension springs 67 does not play a crucial role for implementing the invention. However, the angle between the tension spring longitudinal axes 72, on the one hand, and the first slotted guides 70, on the other hand, is important, see FIG. 19.

These first slotted guides 70 are arranged in the side struts 36', 37' of the backrest support 5''' extending to the front. In an unpivoted state, the first slotted guides 70 extend approximately vertically, the upper end of the slotted guides 70 relative to the lower end being slightly displaced to the rear, see FIGS. 15 and 17. The side struts 36', 37' extend in this case sufficiently far to the front that the transverse shaft 69 in the unpivoted state is located in any case in front of the transverse shaft 35'. In a maximum pivoted state to the rear, when it is located in the lower end position of the first slotted guides 70, the transverse shaft 69 is positioned approximately above the transverse shaft 35', see FIG. 16. If the transverse shaft 69 is located in this state in the upper end position of the first slotted guides 70, the transverse shaft 69 is located behind the transverse shaft 35', see FIG. 18. The position of the transverse shaft 69 in the first slotted guides 70 and thus the distance between the transverse shaft 69 and the transverse shaft 35', as disclosed further below, is dependent on the weight and is adjusted by the user himself or herself, by sitting on the office chair.

Figure 13:
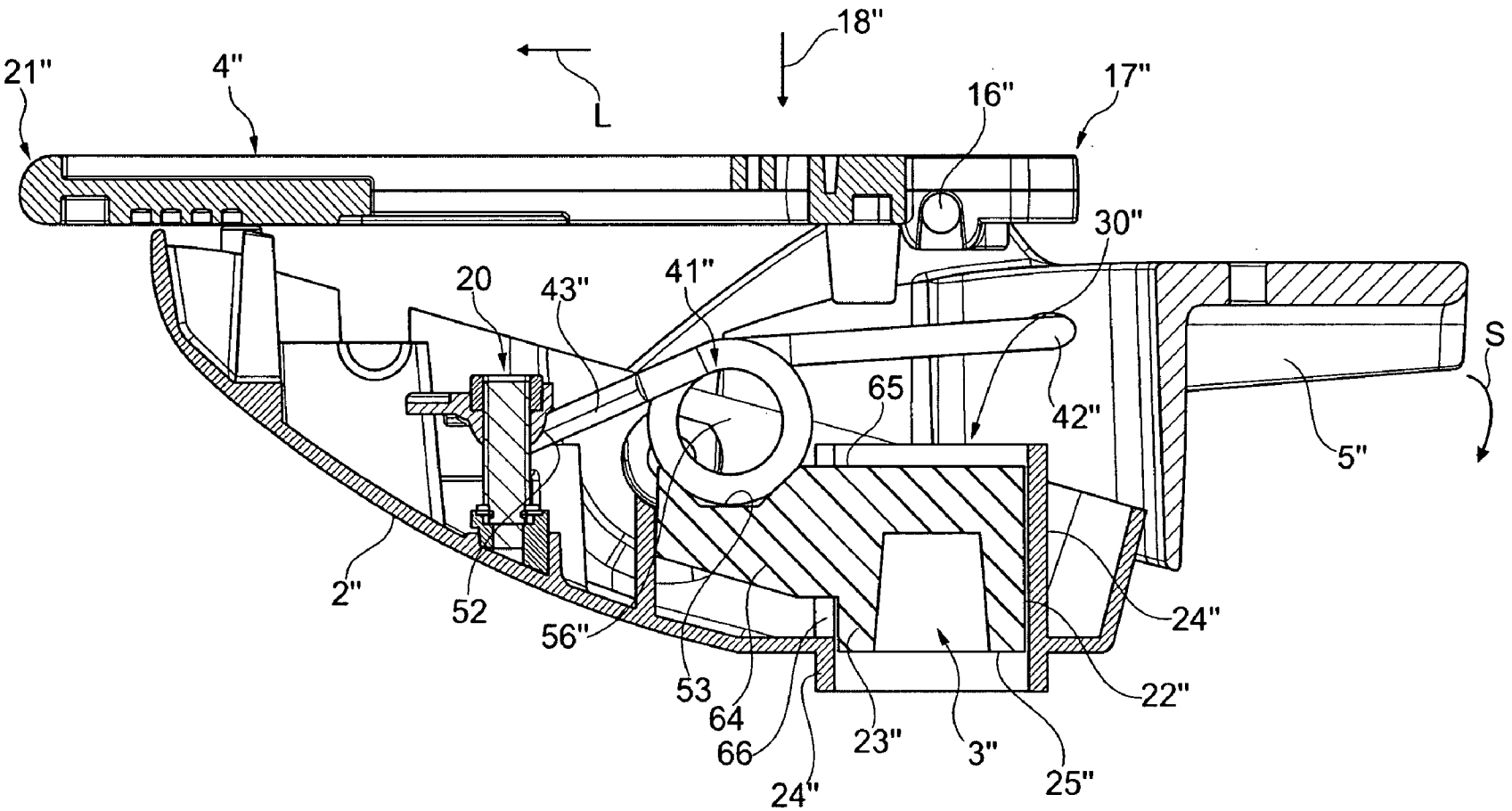
FIG. 13 shows a sectional view of a third synchronous mechanism in the loaded state (along the line BB in FIG. 11)
Figure 14:
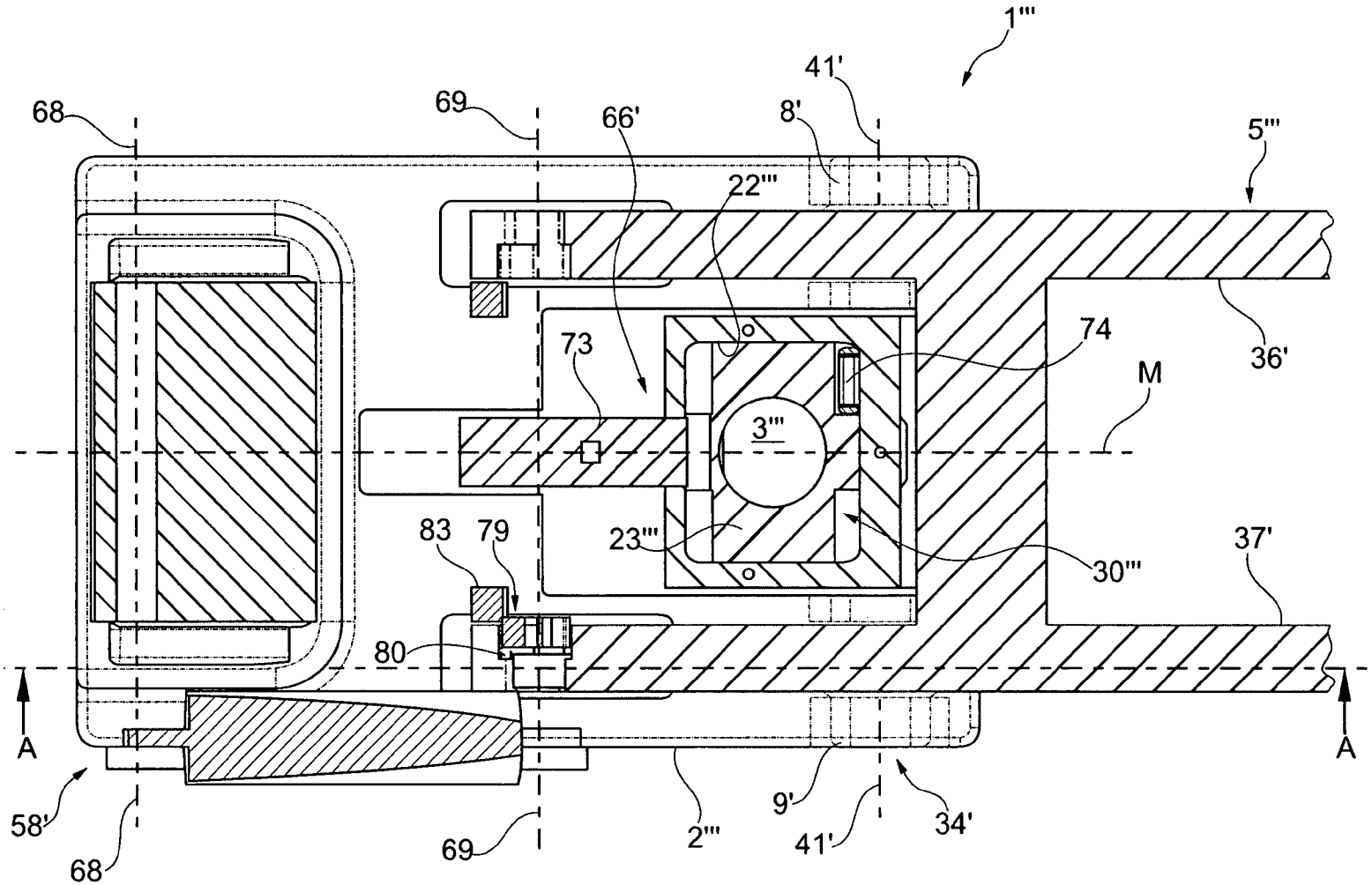
FIG. 14 shows a fourth synchronous mechanism in plan view.
Figure 15:
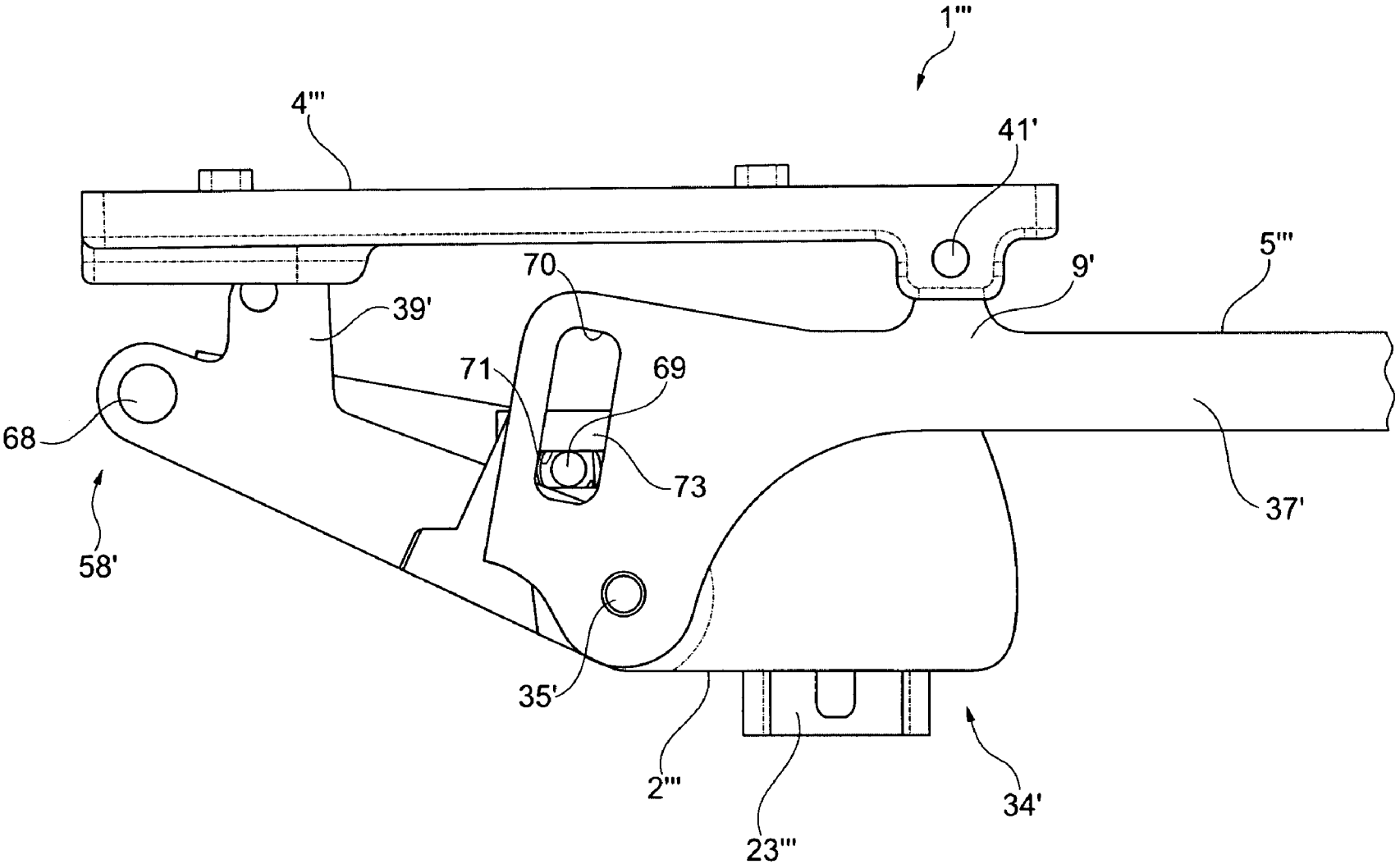
FIG. 15 shows a sectional view of a fourth synchronous mechanism in the unloaded and unpivoted state (along the line AA in FIG. 14)
Figure 16:
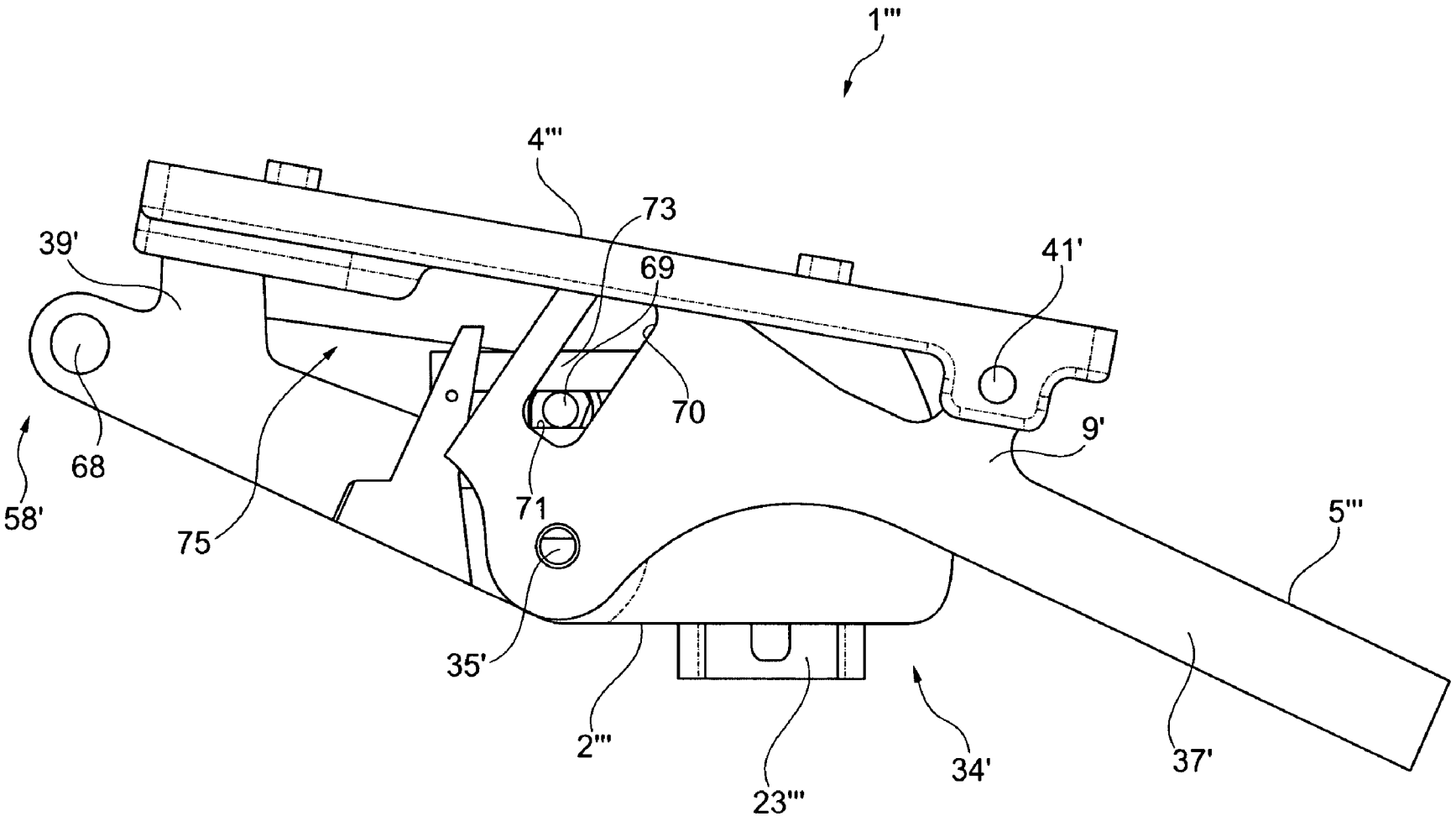
FIG. 16 shows a sectional view of a fourth synchronous mechanism in the unloaded and pivoted state (along the line AA in FIG. 14)

The second slotted guide 71 extends horizontally and is arranged in a drive element 73 located in the central longitudinal plane M, which—similar to the arm 64 in FIGS. 12 and 13—is integrally connected to the guide element 23''' and vertically movable therewith, see FIG. 17. The drive element 73 thus extends from the guide element 23''' out of the guide opening 22''' to such an extent to the front that the first slotted guides 70 permit a displacement of the transverse shaft 69 from a first position in which the transverse shaft 69 is located in front of the transverse shaft 35', into a second position, in which the transverse shaft 69 is located behind the transverse shaft 35'. If the transverse shaft 69 is located in a central position in the slotted guide 71, it is positioned approximately above the transverse shaft 35'. The second slotted guide 71 serves, amongst other things, to allow a pivoting of the backrest support 5''' and thus to allow a synchronous movement, generally in the structure according to the invention.

The tensile force of the tension springs 67 pretensioned between the transverse axes 68, 69, urges the seat support 4''' relative to the base support 2''' forward into the initial position shown. The backrest support 5''' is in this case in its maximum upright position.

If the spring rate of the tension springs 67 is to be altered, an adjusting mechanism is used. This is formed substantially by a vertical linear guide 30''', which is designed as part of the base support 2'''. The linear guide 30''' comprises a square guide opening 22''' arranged in the base support 2''' as well as a guide element 23''' located in the guide opening 22'''. The guide opening 22''' is in this case formed by suitable corresponding sub-elements 24''' (in this case housing parts) of the base support 2'''. On the underside 25''' of the guide element 23''' a conical receiver 3''' is provided for fastening the upper end of the chair column. In other words, the chair column and the guide element 23''' in the assembled state form a sub-assembly which is fixedly located in the guide opening 22''' of the base support 2'''. For secure guidance of the guide element 23''' in the guide opening 22''', a number of rollers are provided in the guide opening 22''' for forming roller bearings 74. Similar to the third embodiment, the front sub-element 24''' of the base support 2''' again has a vertical opening 66' for the drive element 73, see FIG. 14.

As shown in FIG. 17, in the loaded state of the seat support 4''' the guide element 23''' with its upper end 27''' bears against a stop 26''' formed by the base support.

The transverse shaft 69 held movably in the slotted guides 70, 71 is used, therefore, for transmitting the weight of the user to the tension springs 67. The position thereof in the slotted guides—and thus the spring rate of the tension springs 67—is, according to the invention, determined by the weight of the user.

If a load is applied to the seat support 4''' by a user sitting down on the office chair, as is indicated in FIG. 17 by the arrow 47', the moving unit formed by the seat support 4''' and base support 2''', is moved downward as a whole in the direction of movement and namely on a common path of motion, namely a vertically extending straight line 47', relative to the fixed sub-assembly consisting of the chair column and guide element 23'''. The relative movement of the moving unit to the chair column takes place in this connection without the position of the seat support 4''' and base support 2''' being altered relative to one another.

When a load is applied to the office chair by a user, the transverse shaft 69 is driven by the second slotted guide 71 and moved in the first slotted guides 70 into a working position, whereby the spring rate is adjusted. If the user is relatively lightweight, the transverse shaft 69 thus remains in a lower position of the slotted guides 70, see FIGS. 15 and 16. The spring stroke is relatively short. With a heavier user, the transverse shaft 69 is displaced into an upper position in the first slotted guides 70, see FIGS. 17 and 18. The points of articulation of the tension springs 67 are moved apart from one another. The spring stroke is lengthened according to the weight of the user. As a result, by the altered spring rate of the tension springs 67 when a load is applied to the backrest, the pivoting motion S of the seat support 4''' and the backrest support 5''' takes place in the pivoting direction S against a greater "pivoting resistance". In other words, by means of this structural solution, the "initial force" required for pivoting the backrest support 5''' is automatically adjusted depending on the weight of the user. A "sudden drop" when a heavyweight user leans against the backrest, when the office chair has been previously used by a lighter user, is eliminated.

As a result of a load applied to the seat support 4''' by the user, in this embodiment an adjustment of the pivoting resistance takes place independently of a pivoting motion of the backrest. Moreover, it is again provided that the pivoting resistance itself is altered by the pivoting of the backrest. When pushing back the backrest, the backrest support 5''' is namely pivoted to the rear, whereby—much more markedly when a load is applied by a heavyweight user than with a lightweight user—the position of the transverse shaft 69 is again altered, and namely such that the pivoting resistance increases with increasing pivoting.

Figure 20:
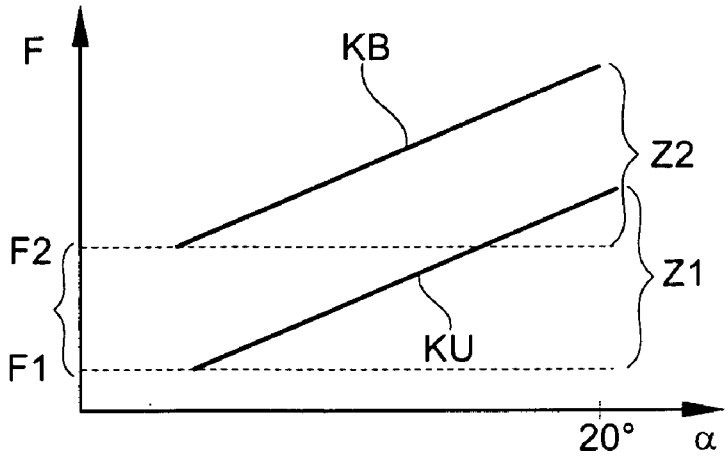
FIG. 20 shows spring characteristics of the first three embodiments.

Whilst, therefore, in the first three embodiments the weight of the user is used to alter the pretensioning of the spring arrangement 75, in the last-described embodiment, the spring rate is adapted to the spring arrangement 75. For an explanation, reference is made to FIGS. 20 to 22, in which a schematic force-path diagram is provided for the first three embodiments. The lower characteristic curve KU represents the unloaded state, the upper characteristic curve KB the loaded state. The intervals F1, F2 of the starting points from the base line correspond to the pretensioning of the spring arrangement. The increases Z1, Z2 produced by the gradient corresponding to the spring stroke, after pivoting about a pivot angle, alpha, of for example 20°.

Figure 21:
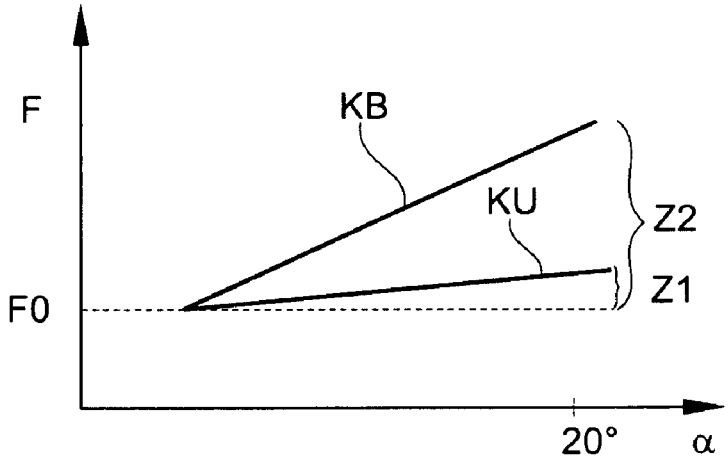
FIG. 21 shows spring characteristics of the fourth embodiment (variant with a 90° arrangement between the longitudinal axis of the tension spring and the first slotted guide)

In FIG. 21, characteristic curves are provided as might be implemented by the fourth embodiment, when the first slotted guides 70 might be arranged exactly perpendicular to the longitudinal axes 72 of the tension springs 67. In this case, a load applied by a user might exclusively lead to an alteration of the spring rate. This variant could also be implemented in an office chair. Both the loaded and the unloaded characteristic curves KB, KU start at a common starting point F0, which is irrespective of the weight of the user. Depending on the weight, however, with a pivoting angle of, for example, 20° a widely varying spring stroke Z1, Z2 results.

Figure 22:
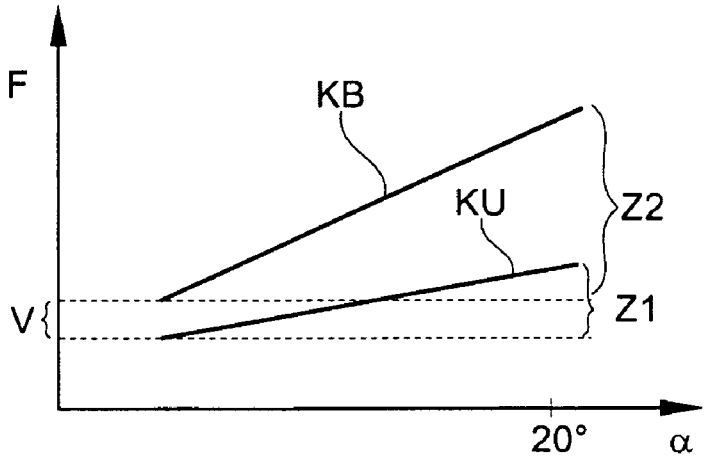
FIG. 22 shows spring characteristics of the fourth embodiment (variant with an arrangement of the first slotted guide deviating from the vertical).

In practice, however, the above-described oblique arrangement of the first slotted guides 70 has proved advantageous, whereby the characteristic curves KU, KB are produced as illustrated in FIG. 22. In addition to the alteration of the spring rate, which takes precedence and which is visible in the different increases Z1, Z2, with a pivoting angle of, for example, 20°, a slight alteration V to the pretensioning of the spring arrangement takes place at the same time, which is reflected in the different starting points of the characteristic curves.

With reference to the fourth embodiment, a safety device is described hereinafter by which an inadvertent adjustment of the spring arrangement 75, adjusted by the weight, may be effectively avoided when pivoting the backrest support 5'''. The use of the safety device is not restricted to the fourth embodiment. The main principle of the safety device is, instead, easily able to be adapted to all embodiments of the invention as well as to other chair mechanisms.

When pivoting the backrest support 5''', restoring forces act on the transverse shaft 69 in the direction of the spring longitudinal axis 72 on the transverse shaft 68, on the one hand, and in the direction of the first slotted guides 70 on the transverse shaft 35', on the other hand. In order to prevent the transverse shaft 69 when pivoting the backrest support 5''' from moving in the first slotted guides 70, a movable latching element 76 is provided which, during pivoting, automatically engages in a fixed retaining element 77 and locks the current setting of the spring rate and/or pretensioning, see FIG. 19.

As a latching element 76, in the example disclosed here, a sleeve 78 is used which is mounted freely rotatably on the transverse shaft 69 which on one side thereof comprises a locking pawl 79 in the manner of a latching edge. The sleeve 78 is in this case fixed on the transverse shaft 69 in the region of one of the first slotted guides 70, such that the locking pawl 79 points forward in the direction of the front inner wall 80 of the first slotted guide 70 and engages in one of the toothlike latching grooves 81 provided there, extending horizontally and used as retaining elements, which are distributed substantially over the entire length of the slotted guide 70. In order to assist this engagement, a spring element is provided, urging the locking pawl 79 in the direction of the latching grooves 81, for example in the form of a small leaf spring 82 or the like. As the disclosed latching is self-locking due to the weight loading by a user, a high spring force is not required, however, in order to bring the locking pawl 79 into a latching position. This takes place almost automatically, as soon as a pivoting of the backrest support 5''' begins.

A release of the locking pawl 79 takes place automatically when pivoting forward the backrest support 5''' into its initial position. In this connection, the latched locking pawl 79 projecting laterally over the slotted guide strikes to this end against a release block 83 arranged adjacent to the relevant inner wall 80 of the first slotted guide 70 and projecting thereover to the rear, so that the latching is released, see FIG. 14. Latching occurs again when the backrest support 5''' is subsequently pivoted.

The latching element 76 does not have to be attached on one side; a separate latching element 76 may also be provided for every first slotted guide 70.

The four embodiments described above merely represent preferred embodiments. The invention may also be used with further synchronous mechanisms as well as with asynchronous mechanisms.

The invention may also be implemented by other transmission means. With the use of a toothed belt as transmission means instead of the guide pulleys, as are used in the second embodiment, gearwheels are preferably used, which prevent the toothed belt from slipping through. Instead of the slotted guide 71 in the drive element 73 in the fourth embodiment, other guides, in particular open and/or partially open guides may also be used. The guide also does not have to be a linear guide. By using non-linear guides, further advantageous adjusting features of the mechanism may be produced. In particular, non-linear characteristic curves of the spring rate may be achieved as a result.

Instead of the above disclosed spring elements, other spring elements may also be used with the invention. Thus, for example, helical springs may be designed as compression springs or tension springs. Also other spring elements, such as for example elastomers or the like, may be used. Also the present invention may be combined with the most varied arrangements of the spring elements. Thus the spring elements may, for example, at positions other than those shown, be arranged in the seat support or base support or even be arranged in the backrest support. For example, the leg spring shown in FIGS. 1 to 4 does not necessarily have to be positioned in front of the linear guide. In further embodiments, it may also be arranged to the rear, above or below the linear guide.

Figure 4:
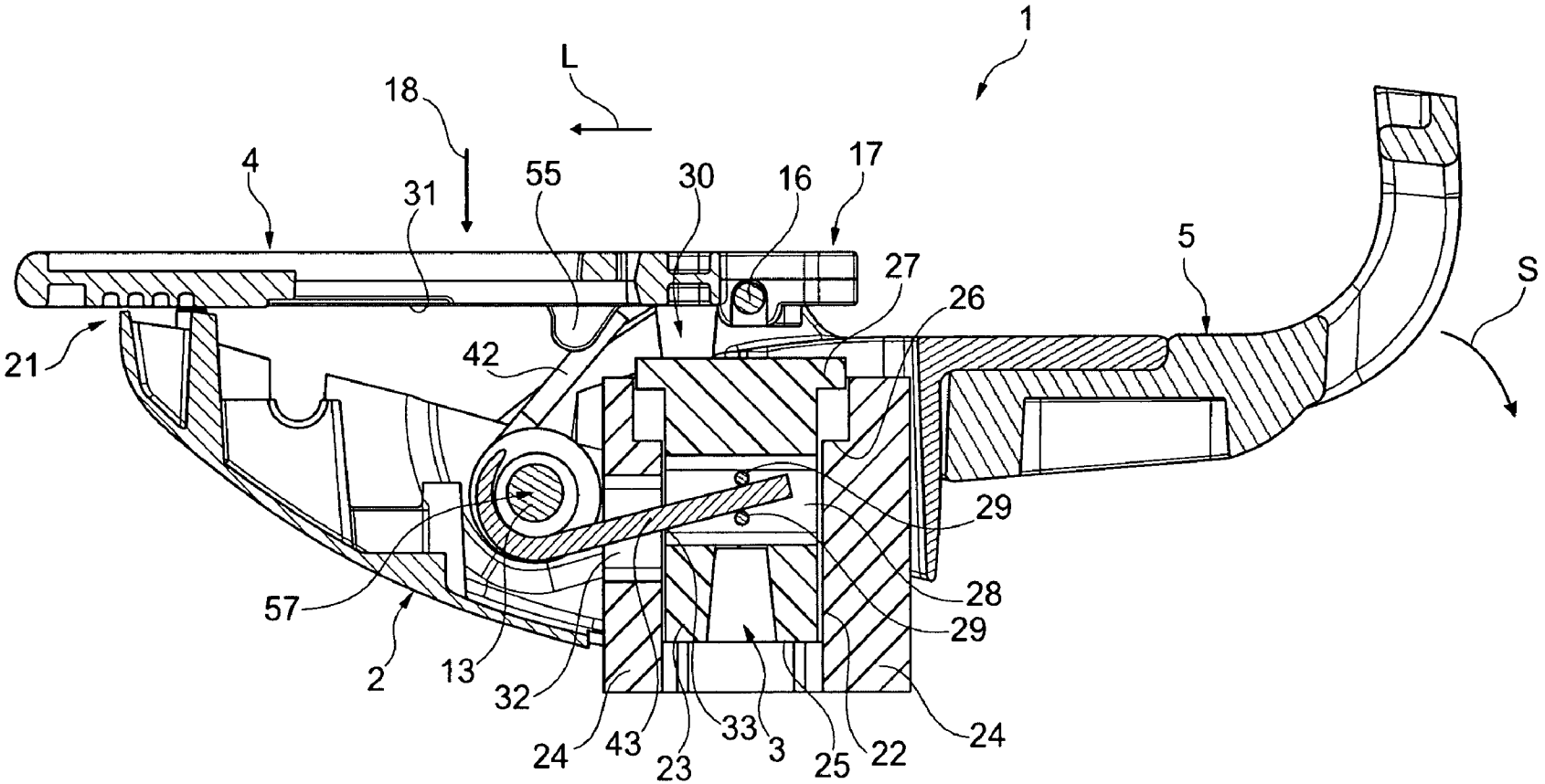
FIG. 4 shows a sectional view of a first synchronous mechanism in the loaded state (along the line AA in FIG. 2)
Figure 5:
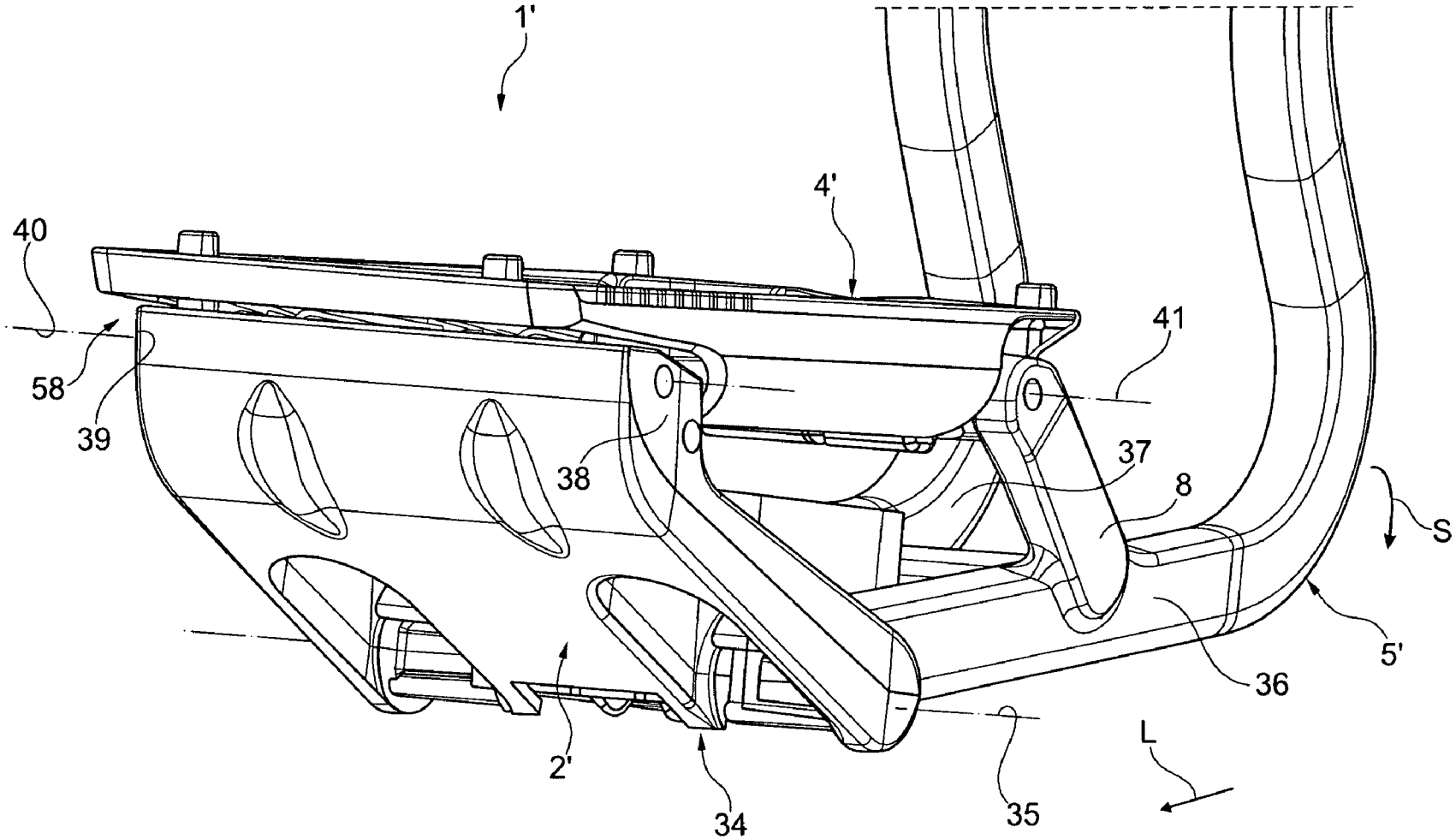
FIG. 5 shows a perspective view of a second synchronous mechanism.
Figure 6:
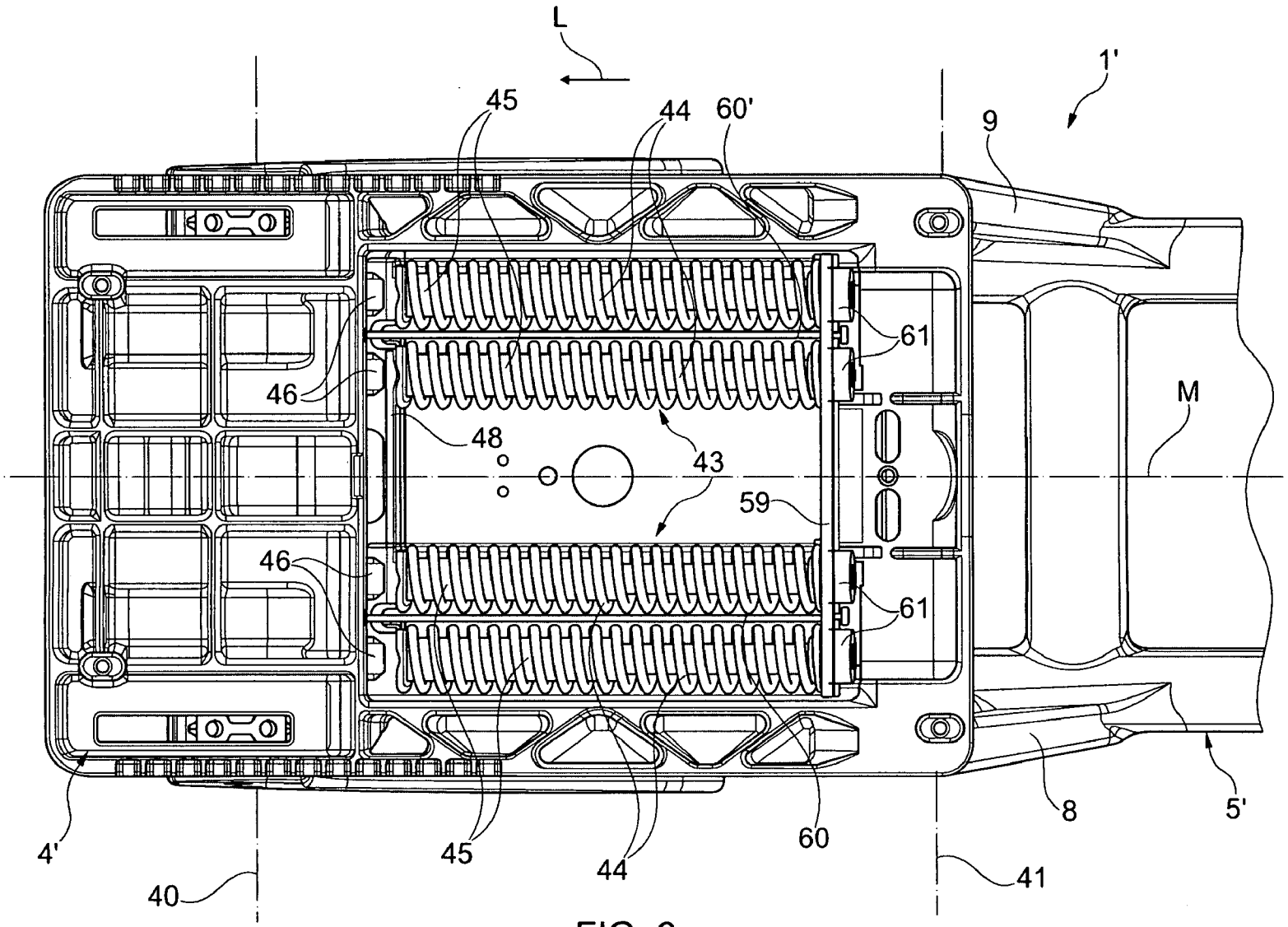
FIG. 6 shows a second synchronous mechanism in the unloaded state in plan view.

The path of motion of the moving unit formed from the seat support 4 and base support 2, also does not necessarily have to extend vertically downward, see FIG. 4. In a further embodiment (not illustrated) of the invention it is provided that the linear guide comprising a guide opening 22 and guide element 23 is not arranged vertically, i.e. parallel to the vertical, but obliquely, i.e. at a specific angle relative to the vertical, in the base support 2 and/or the base support/seat support subassembly. In this case, the user sits on the office chair as shown in FIG. 4. The moving unit formed from the seat support 4 and base support 2, however, does not move downward vertically in the direction of the straight line 18 but on a path of motion extending obliquely to the vertical, which is predetermined by the position of the linear guide.

LIST OF REFERENCE NUMERALS

1 Synchronous mechanism
2 Base support
3 Conical receiver
4 Seat support
5 Backrest support
6 Cheek
7 Cheek
8 Bearing projection
9 Bearing projection
10 Frame element
11 Latching lug
12 Lower cheek end
13 Pivot pin
14 Central longitudinal axis
15 Upper cheek end
16 Joint
17 Rear end region
18 Movement of the moving unit when loaded
19 Joint axis
20 Adjusting mechanism
21 Front end region
22 Guide opening
23 Guide element
24 Sub-element
25 Underside
26 Stop
27 Upper end
28 Transverse opening
29 Guide element
30 Linear guide
31 Underside
32 Through-opening
33 Underside
34 Rear end
35 Transverse shaft
36 Side strut
37 Side strut
38 Bearing post
39 Bearing post
40 Transverse shaft
41 Transverse shaft
42 Upper leg
43 Spring arrangement
44 Helical compression spring
45 Abutment extension arm
46 Bearing head
47 Movement of the moving unit when loaded
48 Supporting strip
49 Bearing recess
50 Spring arrangement
51 Receiver opening
52 Prismatic guide
53 Holding tray
54 Guide strip
55 Prismatic guide
56 Spring center point
57 Fastening screw
58 Front end region
59 Adjusting strip
60 Control cable
61 Opening
62 Guide pulley
63 Guide pulley
64 Arm
65 Upper face
66 Vertical opening
67 Tension spring
68 Transverse shaft
69 Transverse shaft
70 First slotted guide
71 Second slotted guide
72 Tension spring longitudinal axis
73 Drive element
74 Roller bearing
75 Latching element
76 Retaining element
77 Sleeve
78 Locking pawl
79 Inner wall
80 Latching groove
81 Leaf spring
82 Release block

The invention claimed is:

1. A mechanism for an office chair comprising, in combination:

a base support;

a seat support connected to said base support;

a backrest support mounted for pivotal movement rearwardly of said seat support;

a pretensioned spring arrangement for opposing movement of said backrest support;

at least one of said base support and said seat support including a linear guide which transmits movement to said spring arrangement, said linear guide being arranged vertically;

said seat support and said base support define a movable unit connected by said guide to a chair column for linear movement relative to at least a portion of the chair column in the guide as a function of weight of a user applying a load to said seat support, the movement of said movable unit causing an adjustment of a pretensioning of said spring arrangement.

2. The mechanism according to claim 1, wherein said spring arrangement includes at least one spring end of a spring element and the adjustment is caused by an alteration of the position of said at least one spring end when the overall position of said spring element remains substantially the same or is altered.

3. The mechanism according to claim 1, wherein said spring arrangement includes a spring element and the adjustment is caused by an alteration to the position of said spring element relative to a fixed or at least partially movable, spring end of said spring element.

4. The mechanism according to claim 1, wherein said seat support and said base support are arranged such that they do not change a relative position to one another when said movable unit moves.

5. The mechanism according to claim 1, wherein said spring arrangement includes a spring element and during a movement of said movable unit said spring element directly impinges on said movable unit.

6. The mechanism according to claim 5, wherein said movable unit drives said spring element during a movement of said movable unit.

7. The mechanism according to claim 1, wherein said spring arrangement includes a spring element and during a movement of the movable unit said spring element indirectly impinges on said movable unit.

8. The mechanism according to claim 7, wherein said spring arrangement includes another spring element and during a relative movement of said movable unit said other spring element is driven by a transmission unit which cooperates with said movable unit.

9. The mechanism according to claim 8, wherein said transmission unit has a lever, a belt, and a plurality of cooperating slotted guides.

10. The mechanism according to claim 1, wherein said seat support, said base support, and said backrest support define a synchronous mechanism, said seat support is rearwardly pivotable in synchronism with said backrest support and said spring arrangement is configured to act on said synchronous mechanism opposite to the synchronous movement of said seat support and said backrest support.

11. The mechanism according to claim 1, further including a safety device for preventing an adjustment of said spring arrangement by a weight when said backrest support pivots.

* * * * *